US007284776B2

(12) United States Patent
Cummins et al.

(10) Patent No.: US 7,284,776 B2
(45) Date of Patent: Oct. 23, 2007

(54) VEHICULAR DOOR HANDLE INCLUDED SECONDARY LATCH

(75) Inventors: Jerry Cummins, Portland, MI (US); Jim Larabel, Newaygo, MI (US); Brian L. Herrema, Caledonia, MI (US); Joe Meinke, Gowen, MI (US); Mark McWilliams, Grandville, MI (US); Richard Young, Lowell, MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 103 days.

(21) Appl. No.: 10/710,806

(22) Filed: Aug. 4, 2004

(65) Prior Publication Data

US 2006/0091680 A1 May 4, 2006

(51) Int. Cl.
*E05B 3/00* (2006.01)
*E05B 65/10* (2006.01)

(52) U.S. Cl. ..... 292/336.3; 292/92; 292/DIG. 65

(58) Field of Classification Search ..... 292/336.3, 292/92, 347, DIG. 65; 74/535
See application file for complete search history.

(56) References Cited

U.S. PATENT DOCUMENTS

| | | | | | |
|---|---|---|---|---|---|
| 1,776,881 | A | * | 9/1930 | Birdsall | 70/217 |
| 2,196,478 | A | * | 4/1940 | Simpson | 292/210 |
| 2,219,626 | A | * | 10/1940 | Johnson | 74/535 |
| 2,573,028 | A | * | 10/1951 | Kramer | 292/336.3 |
| 2,647,783 | A | * | 8/1953 | Jakeway | 292/336.3 |
| 2,703,729 | A | * | 3/1955 | Jakeway | 292/336.3 |
| 2,800,350 | A | * | 7/1957 | Keeler, II | 292/336.3 |
| 3,111,338 | A | * | 11/1963 | Kimble | 292/111 |
| 3,476,430 | A | * | 11/1969 | Widmer | 292/336.3 |
| 3,544,148 | A | | 12/1970 | Sandor | |
| 3,719,248 | A | | 3/1973 | Breitschwerdt et al. | |
| 3,858,921 | A | * | 1/1975 | Kuki | 292/336.3 |
| 3,967,844 | A | | 7/1976 | Torii et al. | |
| 4,382,622 | A | | 5/1983 | Ishikawa | |
| 5,560,659 | A | | 10/1996 | Dault | |
| 5,669,642 | A | | 9/1997 | Kang | |
| 5,865,481 | A | | 2/1999 | Buschmann | |
| 6,007,122 | A | | 12/1999 | Linder et al. | |
| 6,010,167 | A | | 1/2000 | Tanimoto et al. | |
| 6,042,159 | A | | 3/2000 | Spitzley et al. | |
| 6,070,923 | A | | 6/2000 | Tanimoto et al. | |
| 6,099,052 | A | | 8/2000 | Spitzley | |
| 6,241,294 | B1 | | 6/2001 | Young et al. | |
| 6,378,921 | B1 | * | 4/2002 | Deischl et al. | 292/336.3 |

(Continued)

FOREIGN PATENT DOCUMENTS

EP 1138853 A 10/2001

(Continued)

*Primary Examiner*—Carlos Lugo
(74) *Attorney, Agent, or Firm*—McGarry Bair PC

(57) ABSTRACT

A vehicular door handle assembly comprises a secondary latch with a default active condition for preventing inadvertent movement of the door handle assembly during an impact, such as a collision. The door handle assembly comprises a primary actuator and a secondary actuator in operative communication with the secondary latch for selective deactivation thereof. When the user's hand grasps and pulls the primary actuator in a normal fashion to open the vehicle door, the user's hand simultaneously grasps the secondary actuator and moves the secondary actuator to deactivate the secondary latch and allow movement of the primary actuator and thereby open the vehicular door.

10 Claims, 27 Drawing Sheets

U.S. PATENT DOCUMENTS

| | | | | |
|---|---|---|---|---|
| 6,382,688 | B1 | 5/2002 | Agostini | |
| 6,471,262 | B1 * | 10/2002 | Schwab | 292/336.3 |
| 6,575,508 | B2 | 6/2003 | Stuart et al. | |
| 6,648,382 | B1 | 11/2003 | Monig et al. | |
| 6,709,033 | B2 * | 3/2004 | Jooss et al. | 292/336.3 |
| 2003/0234544 | A1 | 12/2003 | Jankowski et al. | |
| 2005/0161959 | A1 * | 7/2005 | Belchine, III | 292/336.3 |
| 2006/0038417 | A1 * | 2/2006 | Pudney | 292/336.3 |
| 2006/0038418 | A1 * | 2/2006 | Huizenga et al. | 292/336.3 |

FOREIGN PATENT DOCUMENTS

| | | | |
|---|---|---|---|
| EP | 1217155 | A | 6/2002 |
| FR | 2359457 | A | 2/1978 |
| WO | WO2005021906 | A | 10/2005 |

* cited by examiner

VEHICULAR DOOR HANDLE INCLUDED SECONDARY LATCH

FIELD OF THE INVENTION

The invention relates generally to a vehicular door handle and more particularly to an external vehicular door handle having a secondary latch to prevent undesired opening of the vehicular door as a result of impact to the vehicle.

DESCRIPTION OF THE RELATED ART

Vehicular doors typically comprise a primary latch for retaining the door in a closed position, a handle mechanism mounted on the exterior surface of the door for selectively actuating the primary latch so that the door can be moved to an open position, and a lock for selectively preventing movement of the handle mechanism and, thus, actuation of the primary latch. Consequently, when the door is locked, it cannot be inadvertently opened, such as during impacts resulting from collisions with other vehicles or with stationary objects. However, if the door is unlocked, such impacts can result in undesired inertial movement of the handle, which can thereby actuate the primary latch and open the door. If the door opens during a collision, passengers in the vehicle can be thrown from the vehicle or otherwise injured.

To satisfy the Federal Motor Vehicle Safety Standards (FMVSS), which establish vehicle requirements in the event of a collision, some external vehicular handles comprise a secondary latch that prevents inadvertent movement of the handle mechanism at least during an impact having a force equal to the minimum force designed by the FMVSS. Some of these secondary latches are inertia-based latches that are normally in an inactive condition and are activated during the impact. Others are active latches that have a default active condition and must be inactivated by a user when opening the door. The latter type of secondary latches are more reliable in that they are always activated and do not require a minimum force for activation. However, active latches require the user to perform a two-step door opening process: a first step to inactivate the secondary latch and a second step to actuate the primary latch to open the door. Users can become irritated and annoyed with the two-step process, especially if the user needs to open the door quickly, such as when the user's hands are full or during inclement weather.

SUMMARY OF THE INVENTION

A vehicular door handle assembly according to the invention for selectively opening a vehicle door comprises a primary actuator adapted to be mounted to a vehicle door, wherein the primary actuator has a first user interaction portion for moving the primary actuator between a latched position and an opened position, and wherein the vehicle door is opened by a user by moving the user interaction portion of the primary actuator between the latched position and the opened position; and a secondary actuator operatively associated with the primary actuator, wherein the secondary actuator has a second user interaction portion for moving the secondary actuator between a secure position, wherein movement of the primary actuator from the latched position to the opened position is prevented, and a release position, wherein the primary actuator can move from the latched position to the opened position. The second user interaction portion is aligned with at least a portion of the first user interaction portion so that attempted movement of the primary actuator out of the latched position first causes the secondary actuator to be moved from the secure position to the release position.

The primary actuator can comprise a handle, and the first user interaction portion can comprise a handle hand grip region. Further, the secondary actuator can comprise a trigger mounted to the handle, and the second user interaction portion can comprise a trigger hand grip region. During the attempted movement of the primary actuator out of the latched position, the user grasps both the handle hand grip region and the trigger hand grip region and moves the trigger hand grip region towards the handle hand grip region to move the trigger from the secure position to the release position. The trigger can be pivotally mounted to the handle.

The vehicular door handle assembly can further comprise a biasing member that biases the secondary actuator to the secure position. The biasing member can be a leaf spring.

The vehicular door handle assembly can further comprise a latch operatively associated with the secondary actuator and operable between an active condition, wherein the latch prevents movement of the primary actuator from the latched position, and an inactive condition, wherein the latch allows movement of the primary actuator from the latched position, and wherein movement of the secondary actuator from the secure position to the release position inactivates the latch. Additionally, the vehicular door handle assembly can comprise a latch receiver adapted to be mounted to the vehicle door adjacent the primary actuator such that the latch is partially received by the latch receiver and partially received by the primary actuator when the latch is in the active condition.

The vehicular door handle assembly according can further comprise a biasing member that biases the secondary actuator to the secure position and the latch to the active condition, and movement of the secondary actuator against the bias of the biasing member to the release position withdraws the latch from the latch receiver to the inactivate the latch. The biasing member biases the secondary actuator away from the primary actuator, and the attempted movement of the primary actuator out of the latched position causes the secondary actuator to be moved against the bias of the biasing member and towards the primary actuator.

The secondary actuator can be pivotally mounted to the primary actuator, and pivotal movement of the secondary actuator relative to the primary actuator translates into linear movement of the latch relative to the latch receiver. The latch can comprise at least one flange, and the secondary actuator can comprise a cam in operative communication with the at least one flange to effect the linear movement of the latch. The cam can comprise at least one pair of arms that define a groove therebetween, and the at least one flange can be slidingly received by the groove.

Alternatively, the latch can comprise at least one flange, the secondary actuator can comprises at least one arm, and during the movement of the primary actuator from the secure position to the release position, the at least one arm abuts the at least one flange to induce movement of the latch out of the latch receiver to the inactive condition.

Alternatively, the secondary actuator can comprises a button connected to the latch through a pivot arm pivotally mounted the primary actuator. The latch can comprise a detent that is positioned within the latch receiver when the latch is in the active condition. The attempted movement of the primary actuator from the latched position causes depression of the button and movement of the detent out of the latch receiver.

Alternatively, the vehicle door handle assembly can further comprise a latch biasing member that biases the latch into the latch receiver. The latch can be magnetic, and the secondary actuator can comprise a magnet that draws the latch from the latch receiver when the secondary actuator is in the release position. The latch biasing member can comprise a magnet, wherein the magnet of the secondary actuator is stronger than the magnet of the latch biasing member. Optionally, the latch biasing member can comprise a spring that surrounds the latch and is held in place by a retaining head on an end of the latch. Alternatively, the latch biasing member can comprise a magnet, and the vehicular door handle assembly can further comprise a second latch biasing member operably mounted to the latch to bias the latch to the inactive condition, wherein attraction of the latch to the magnet is stronger than the bias of the second latch biasing member.

Alternatively, the primary actuator can comprise a paddle, and the secondary actuator can comprise a trigger pivotally mounted to the paddle. The trigger can comprise a latch mounted thereto and operable between an active condition, wherein the latch prevents movement of the paddle from the latched position, and an inactive condition, wherein the latch allows movement of the paddle from the latched position, and wherein movement of the trigger from the secure position to the release position inactivates the latch. The latch can extend through an aperture in a door panel of the vehicular door and can comprises a detent that abuts an inside surface of the door panel when the latch is in the active condition, and wherein pivotal movement of the trigger from the secure position to the release position removes the detent from abutting contact with the inside surface the door panel to inactivate the latch so that the paddle can move from the latched position to the opened position.

In another aspect, a vehicular door handle assembly according to the invention for selectively opening a vehicular door comprises a primary actuator adapted to be mounted to a vehicle door and movable between a latched position and an opened position, and wherein the vehicle door is opened by a user by moving the primary actuator between the latched position and the opened position; and a secondary actuator operatively associated with the primary actuator and movable between a secure position, wherein movement of the primary actuator from the latched position to the opened position is prevented, and a release position, wherein the primary actuator can move from the latched position to the opened position. The primary actuator and the secondary actuator have a common actuation path so that attempted movement of the primary actuator out of the latched position first causes the secondary actuator to be moved from the secure position to the release position. The common actuation path can be linear or, alternatively, arcuate.

The primary actuator can comprise a handle with a first user interaction portion, and the secondary actuator can comprise a trigger mounted to the handle and having a second user interaction portion. During movement of the primary actuator and the secondary actuator through the common actuation path, the user grasps both the first user interaction portion and the second user interaction portion and moves the second user interaction portion towards the first user interaction portion to move the trigger to the release position. The first and second user interaction portions can be hand grip regions on the handle and on the trigger.

In yet another aspect, a vehicular door handle assembly for selectively opening a vehicular door according to the invention comprises an actuator adapted to be mounted to a vehicle door and movable through an actuation path to an opened position, and wherein the vehicle door is opened by a user by moving the actuator to the opened position; and a latch operatively associated with the actuator for selectively preventing movement of the actuator to the opened position. The actuation path comprises a first portion and a second portion, and movement of the actuator through the first portion deactivates the latch so that the actuator can move through the second portion to the opened position, and wherein the first portion and the second portion of the actuation path are serially aligned and substantially indistinguishable to a user during attempted movement of the actuator to the opened position.

The actuator can comprise a secondary actuator movable to a release position during the first portion of the actuation path for deactivating the latch. Further, the actuator can have a first user interaction portion for moving the actuator to the opened position, the secondary actuator can have a second user interaction portion for moving the secondary actuator to the release position, wherein the second user interaction portion is aligned with at least a portion of the first user interaction portion so that the attempted movement of the actuator to the opened position first causes the secondary actuator to be moved through the first portion of the actuation path. The actuator can comprise a handle, and the first user interaction portion can comprise a handle hand grip region. The secondary actuator can comprise a trigger mounted to the handle, and the second user interaction portion can comprise a trigger hand grip region. During the attempted movement of the actuator to the opened position, the user grasps both the handle hand grip region and the trigger hand grip region and moves the trigger hand grip region towards the handle hand grip region during the first portion of the actuation path.

DESCRIPTION OF THE PREFERRED EMBODIMENT

Figure 1:
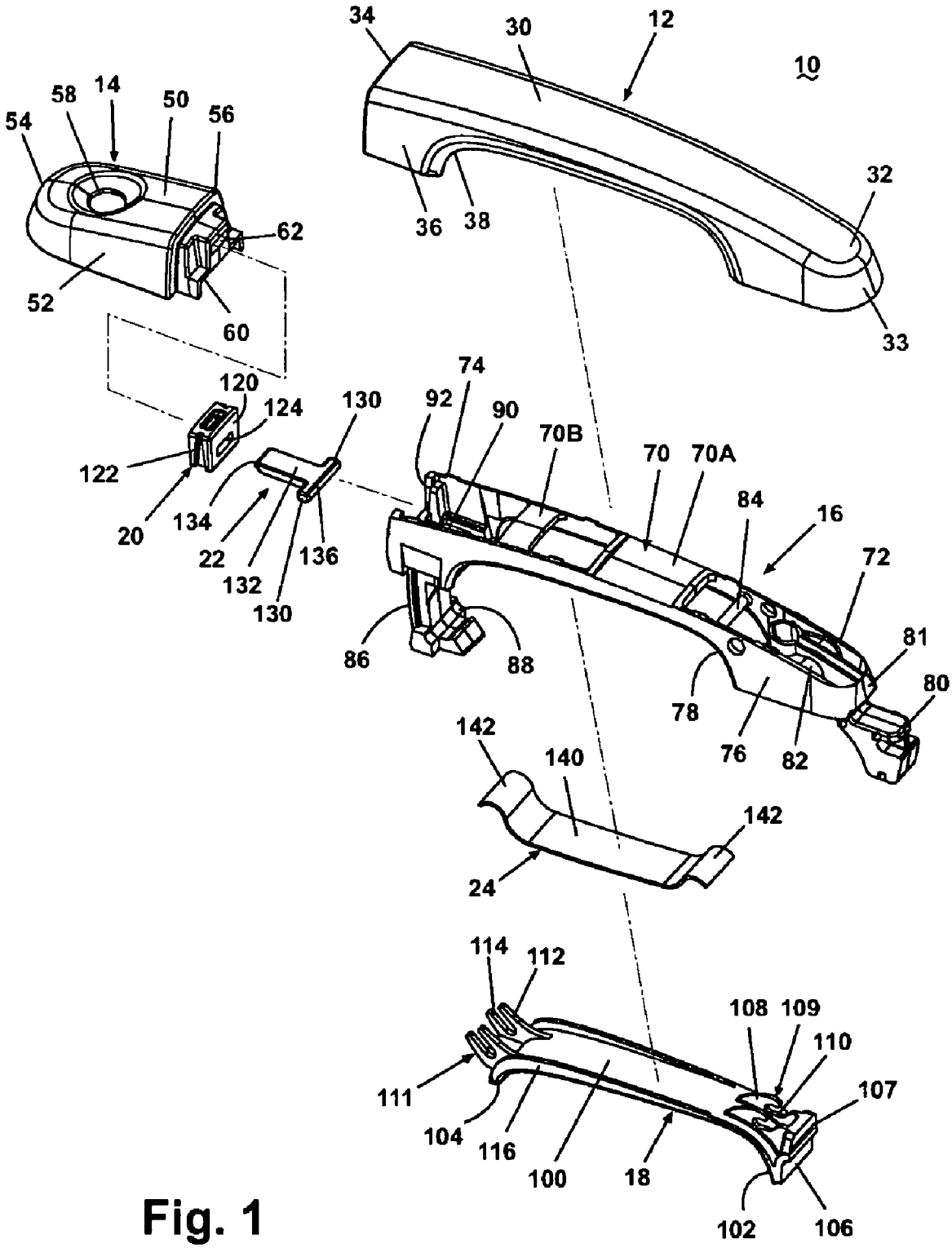
FIG. 1 is an exploded view of a first embodiment of a vehicular door handle assembly according to the invention and comprising a primary actuator in the form of a handle grip and a housing, a secondary latch, and a secondary actuator in the form of a trigger in operative communication with the secondary latch.

To alleviate the deficiencies of the prior art, a vehicular door handle according to the invention comprises a secondary latch with a default active condition to prevent inadvertent movement of the handle and is deactivated by actuation of a trigger when a user grasps the handle in a normal fashion. Hence, the secondary latch reliably prevents opening of the door during an impact and can be conveniently inactivated when the user desires to open the door.

Referring now to the figures and particularly to FIGS. 1-5, a first embodiment vehicular door handle assembly 10 according to the invention comprises a housing 16 that supports several components of the door handle assembly 10, including a handle grip 12, a secondary latch 22 with a default active condition for preventing movement of the housing 16 and the handle grip 12, a trigger 18 for moving and thereby deactivating the secondary latch 22, a bearing 20 for guiding movement of the secondary latch 22, and a biasing member 24 for biasing the trigger 18 to a secure position that corresponds to the active condition of the secondary latch 22. The door handle assembly 10 further comprises an end cap 14 positioned adjacent the housing 16 and adapted to partially receive the secondary latch 22 when the secondary latch 22 is in the active condition. In general, movement of the trigger 18 against the force of the biasing member 24 converts the secondary latch 22 from the active condition to an inactive condition to enable a user to move the handle grip 12 and housing 16 for unlatching a primary latch of a vehicle door. When the door handle assembly 10 is mounted to a vehicle door panel 26 or other outermost layer of a vehicle door assembly, all of the components of the door handle assembly 10 are situated on the exterior side 28 of the door panel 26, except for portions of the housing 16, as will be described hereinafter.

In the following description of this and other embodiments of the invention, the door handle assembly 10 is characterized with respect to a forward, rearward, upper, and lower orientation, wherein forward is towards a front end of the vehicle, rearward is towards a rear end of the vehicle, upper is away from the vehicle door, and lower is closer to the vehicle door. This orientation is for exemplary purposes only and is not meant to limit the invention in any manner. It will be apparent to one of ordinary skill in the vehicular handle art that the door handle assembly 10 can be positioned on a vehicular door in any suitable fashion.

With continued reference to FIGS. 1, 2A-2C (the trigger 18 and handle grip 12 are not shown in FIGS. 2B and 2C, respectively, for illustrative purposes), and 3, the housing 16 is a generally arcuate, elongated frame-like structure comprising a closed forward end 72, an open rearward end 74, opposing side walls 76, and a segmented upper wall 70 having a forward segment 70A and a rearward segment 70B that join the upper edges of the side walls 76. Each of the side walls 76 includes an arcuate cutout 78 to accommodate a user's hand. At the forward end 72 of the housing 16, the side walls 76 are joined by a forward wall 81 and a first lower wall 82, and at the rearward end 74, the side walls 76 are joined by a second lower wall 90.

A pivot member 80 extends from the forward end 72 of the housing 16 and, when the door handle assembly 10 is mounted to the door panel 26, through an aperture in the door panel 26 and into an interior side 27 of the door panel 26 to pivotally connect with a corresponding pivot support member (not shown) in the door. Hence, the housing 16 and the components supported thereby can pivot about the pivot member 80 and relative to the door panel 26. At the rearward end 74 of the housing 16, a primary latch actuator 86 with a primary latch actuating arm 88 extends from the second lower wall 90 such that when the door handle assembly 10 is mounted to the door panel 26, the primary latch actuator 86 extends through an aperture in the door panel 26 to reside on the interior side 27 of the door panel 26. The primary latch actuating arm 88 is in operative communication with a primary latch (not shown), and movement of the primary latch actuating arm 88 towards the door panel 26 by pivoting the housing 16 at the pivot member 80 from a latched position to an opened position moves the primary latch from a latched state, wherein the door is held in a closed position, to an opened state, wherein the door can be moved to an open position. When the housing 16 is in the latched position, the longitudinal axis of the door handle assembly 10 is substantially parallel to the door panel 26, and the primary latch is in the latched state. Conversely, when the housing 16 is in the opened position, the door handle assembly 10 is pivoted relative to the door panel 26, and the primary latch is in the opened state.

The housing 16 further comprises various structures for mounting other components of the door handle assembly 10. Such structures include a crossbar 84 disposed between the side walls 76 and near the forward segment 70A of the upper wall 70 for pivotally mounting the trigger 18. Further, to mount the bearing 20, the housing 16 comprises opposed elongated projections 92 that extend inward from the side walls 76 at the rearward end 74.

The handle grip 12, in general, is an outer shell shaped to overlie the housing 16 for providing an aesthetic appearance to the door handle assembly 10 and to help provide structural support to the door handle assembly 10. Alternatively, the handle grip 12 can be integral with the housing 16. The handle grip 12 comprises forward and rearward ends 32, 34 and opposing side walls 36 joined by a curved forward wall 33 and an upper wall 30 contoured according to the shape of the housing 16. Further, the handle grip 12 is slightly longer than the housing 16 such that the rearward end 34 extends beyond the rearward end 74 of the housing 16 when the handle grip 12 is mounted to the housing 16. As with the housing 16, each of the side walls 36 includes an arcuate cutout 38 to accommodate the user's hand. To facilitate mounting the handle grip 12 to the housing 16, the handle grip 12 further comprises rearward tabs 42 that are integral with the lower edges of the side walls 38 and extend inward towards each other and an inwardly extending forward tab 40 integral with lower edge of the forward wall 33.

The trigger 18 is attached to the housing 16 on the side opposite the handle grip 12 and is biased away from the housing 16 to the secure position by the biasing member 24, which comprises a generally flat, elongated central portion 140 between curved ends 142. The trigger 18 comprises an elongated trigger grip 100 having curved forward and rearward ends 102, 104 and opposing side walls 116. The curvature of the trigger grip 100 corresponds to the arcuate cutouts 38, 78 in the side walls 36, 76 of the handle grip 12 and the housing 16, respectively. The trigger 18, at its forward end 102, terminates at a forward wall 106 with a protruding portion 107 and includes spaced trigger mounts 109. Each trigger mount 109 comprises a hook 108 that defines a channel 110 sized to receive the crossbar 84 on the housing 16. The rearward end 104 comprises a pair of secondary latch mounts 111 integral therewith, and each of the secondary latch mounts 111 comprises a cam in the form of two inclined, elongated arms 112 with an inclined U-shaped groove 114 therebetween sized for receiving the secondary latch 22, as will be described hereinafter.

The secondary latch 22 comprises a rectangular latch body 132 with a tapered rearward end 134, a forward end 136 with a pair of flanges 130 sized for receipt in the grooves 114 of the trigger 18. As stated above, movement of the latch body 132 is guided by the bearing 20, which comprises a generally rectangular parallelopiped body 120 having a central passageway 124 sized and shaped for receiving the latch body 132. The body 120 further comprises opposing outer grooves 122 sized to mate with the projections 92 on the housing 16 for mounting the bearing 20 to the housing 16.

The end cap 14 of the door handle assembly 10 is mounted to the exterior side 28 of the door panel 26 adjacent the housing 16 and optionally covers a lock assembly (not shown) in operative communication with the primary latch. The end cap 14 comprises side walls 52 joined by an upper wall 50, a curved rear wall 54, and a flat forward wall 56 having an integral secondary latch receiver 60 that projects beyond the forward wall 56. The secondary latch receiver 60 includes a secondary latch channel 62 shaped and sized to receive the rearward end 134 of the latch body 132.

Together, the housing 16 and the handle grip 12 form a primary actuator that operatively communicates with the primary latch. Movement of the primary actuator from the latched position to the opened position moves the primary latch from the latched state to the opened state so that the user can open the vehicle door. The primary actuator includes a first user interaction portion that the user grasps when attempting to open the vehicle door. In this embodiment, the user interaction portion is formed by the arcuate cutouts 38, 78 in the housing 16 and the handle grip 12. Hence, to move the primary actuator from the latched position to the opened position, the user grasps the first interaction portion defined by the arcuate cutouts 38, 78 and pulls the primary actuator away from the door panel 26 to pivot the primary actuator about the pivot member 80.

The ability of the primary actuator to move from the latched position is controlled by a secondary actuator in the form of the trigger 18. Movement of the trigger 18 from the secure position to a release position deactivates the secondary latch 22 so that the primary actuator can move from the latched position. The secondary actuator defaults to the secure position, wherein movement of the primary actuator from the latched position is prevented. However, the secondary actuator can move from the secure position to a release position, wherein the primary actuator is able to move from the latched position. Similar to the primary actuator, the secondary actuator comprises a second user interaction portion that the user grasps to move the secondary actuator from the secure position to the release position. In this embodiment, the trigger grip 100 functions as the second user interaction portion. The first and second user interaction portions are aligned such that when a user grasps the door handle assembly 10 in order to open the door, the user must grasp both the primary actuator and the second actuator simultaneously. Hence, in this embodiment, when attempting to open the door, the user grasps both the first interaction portion defined by the arcuate cutouts 38, 78 and second user interaction portion formed by the trigger grip 100.

Figure 3:
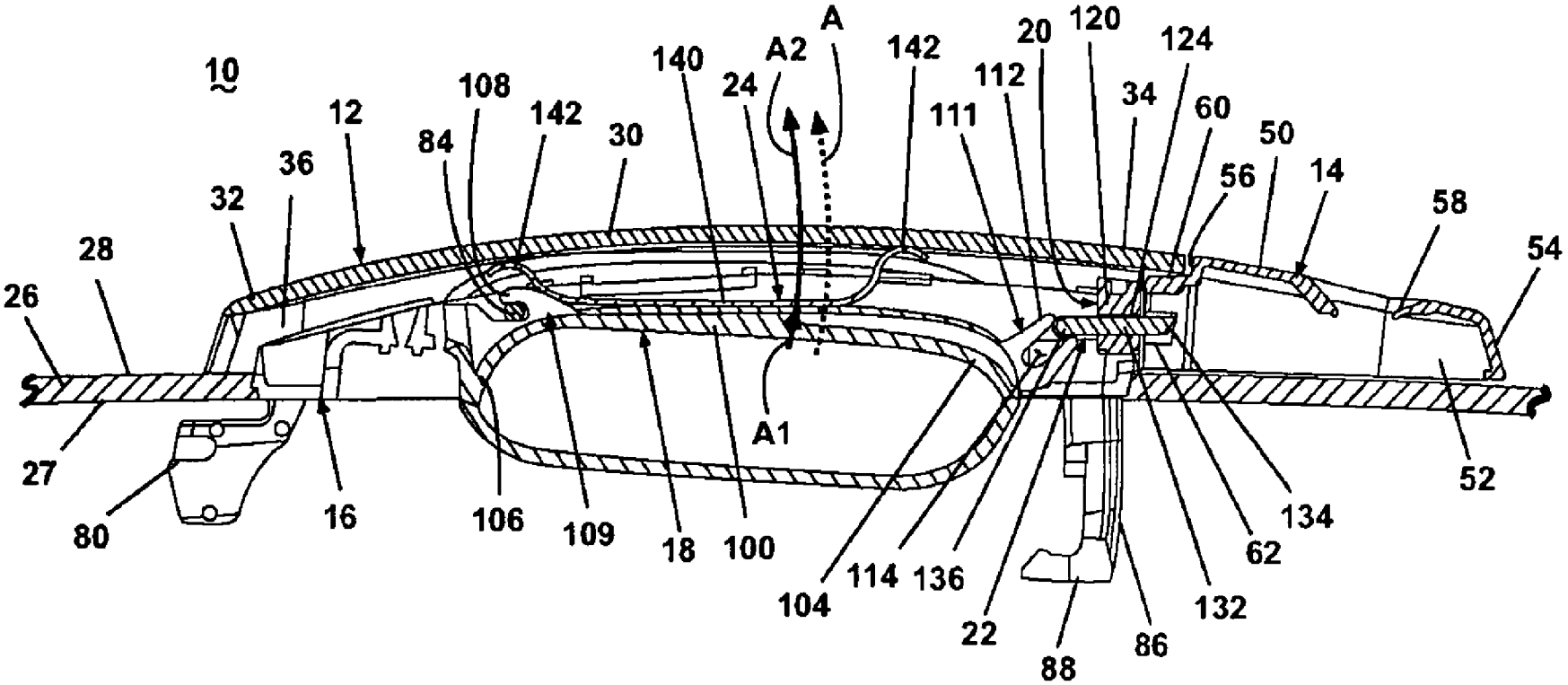
FIG. 3 is a sectional view of the vehicular door handle from FIG. 1, wherein the secondary latch is in an active condition and the primary actuator is in a latched position.

Referring now to FIG. 3, when the door handle assembly 10 is assembled and attached to the vehicle door, the housing 16 is mounted to the vehicle door panel 26 such that the pivot member 80 and the primary latch actuator 86 are on the interior side 27 of the door panel 26, and the rest of the housing 16 is located on the exterior side 28 of the door panel 26. The pivot member 80 is coupled with its corresponding pivot support member, and the primary latch actuating arm 88 operatively communicates with the primary latch. The end cap 14 is mounted to the exterior side 28 of the door panel 26 and adjacent the rearward end 74 of the housing 16.

The handle grip 12 is positioned over the housing 16 and is mounted thereto by the rearward tabs 42 and the forward tab 40. In particular, the rearward tabs 40 wrap around the lower edges of the housing side walls 76 at the rearward end 74 of the housing 16, and the forward tab 42 similarly abuts the lower edge of the housing forward wall 81. The handle grip 12 covers the housing 16 and extends rearward of the housing 16 to abut the forward wall 56 of the end cap 14. Hence, the handle grip 12 conceals the secondary latch receiver 60 from view when the door handle assembly 10 is in the latched position.

Figure 2A:
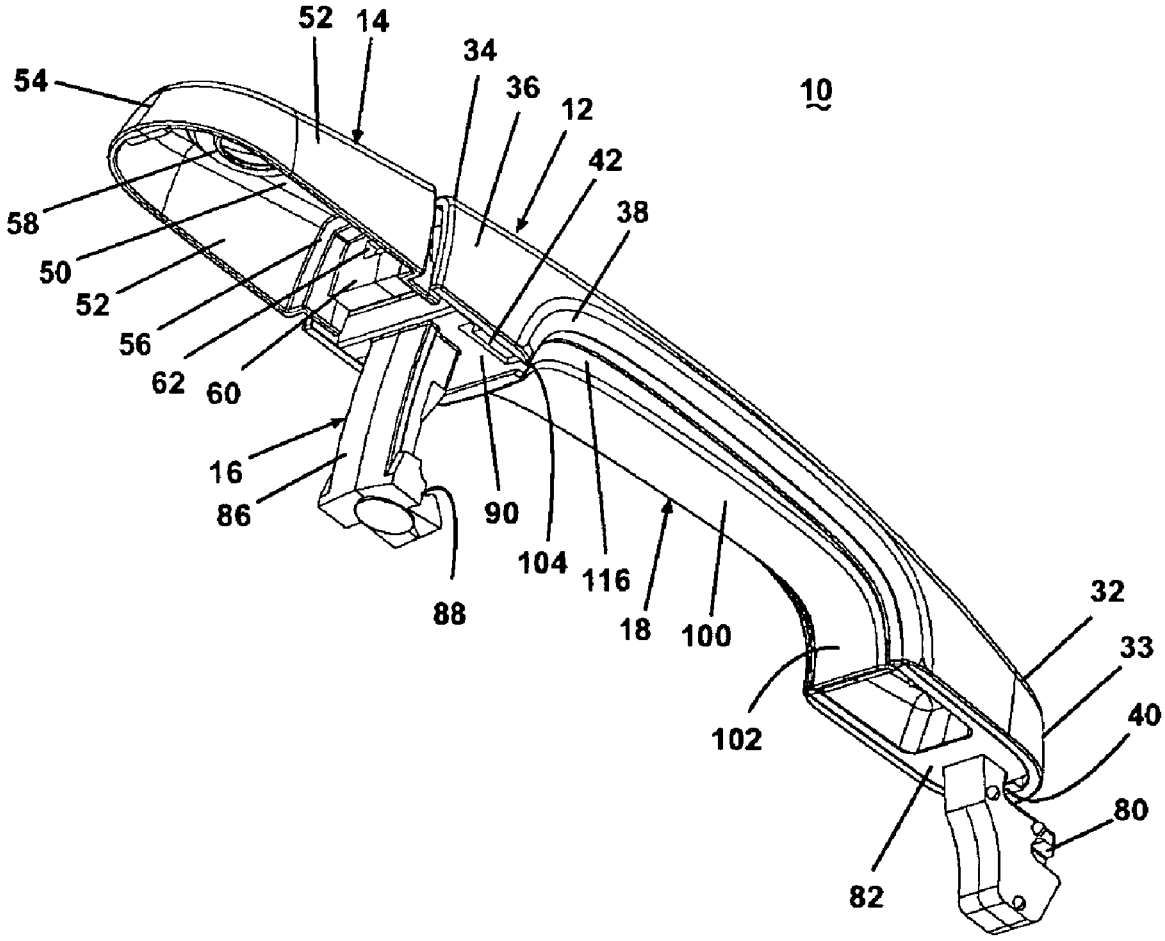
FIG. 2A is a perspective view of the vehicular door handle assembly shown in FIG. 1.
Figure 2B:
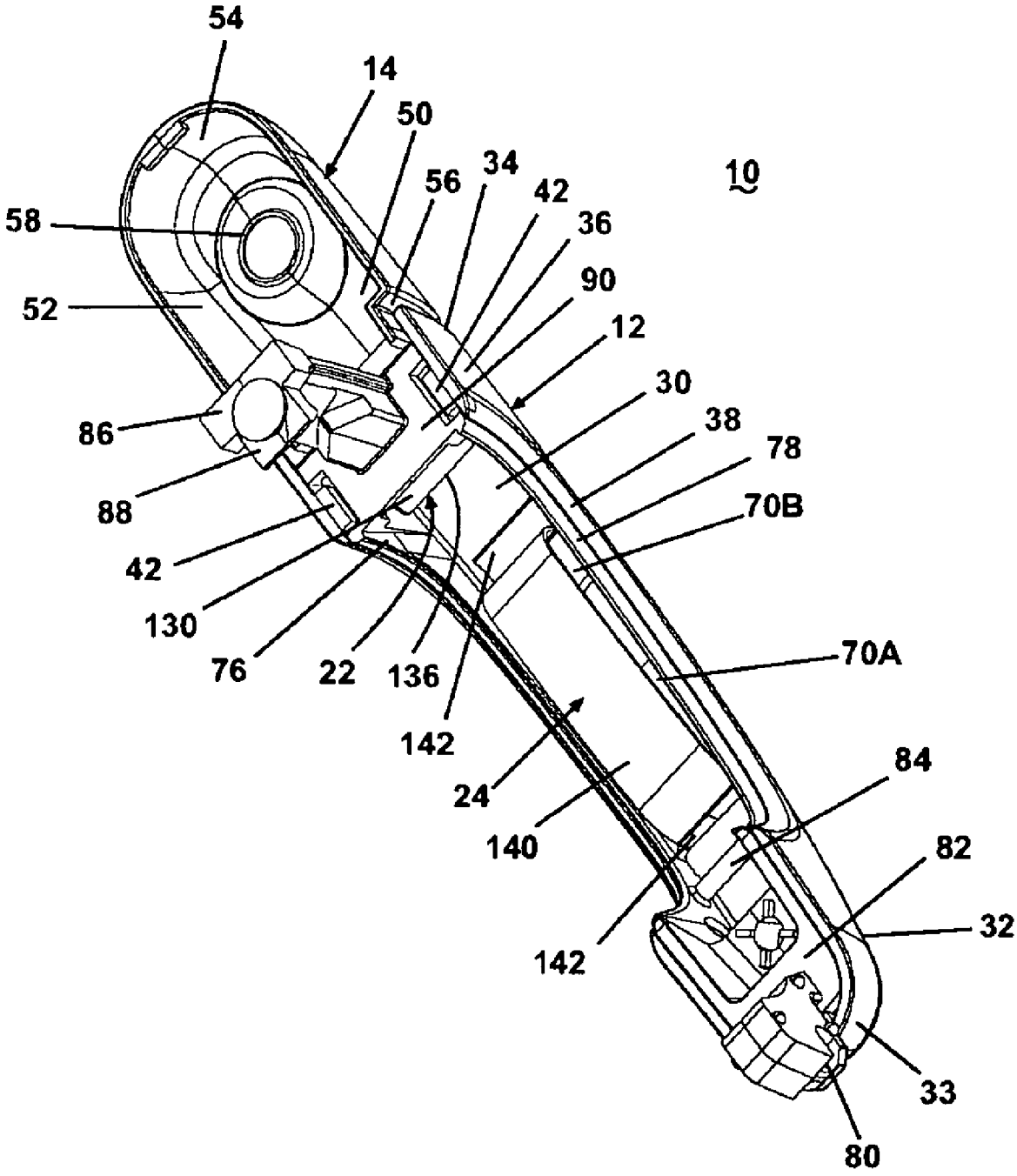
FIG. 2B is a perspective view of the vehicular door handle assembly shown in FIG. 1, wherein the trigger is removed.
Figure 2C:
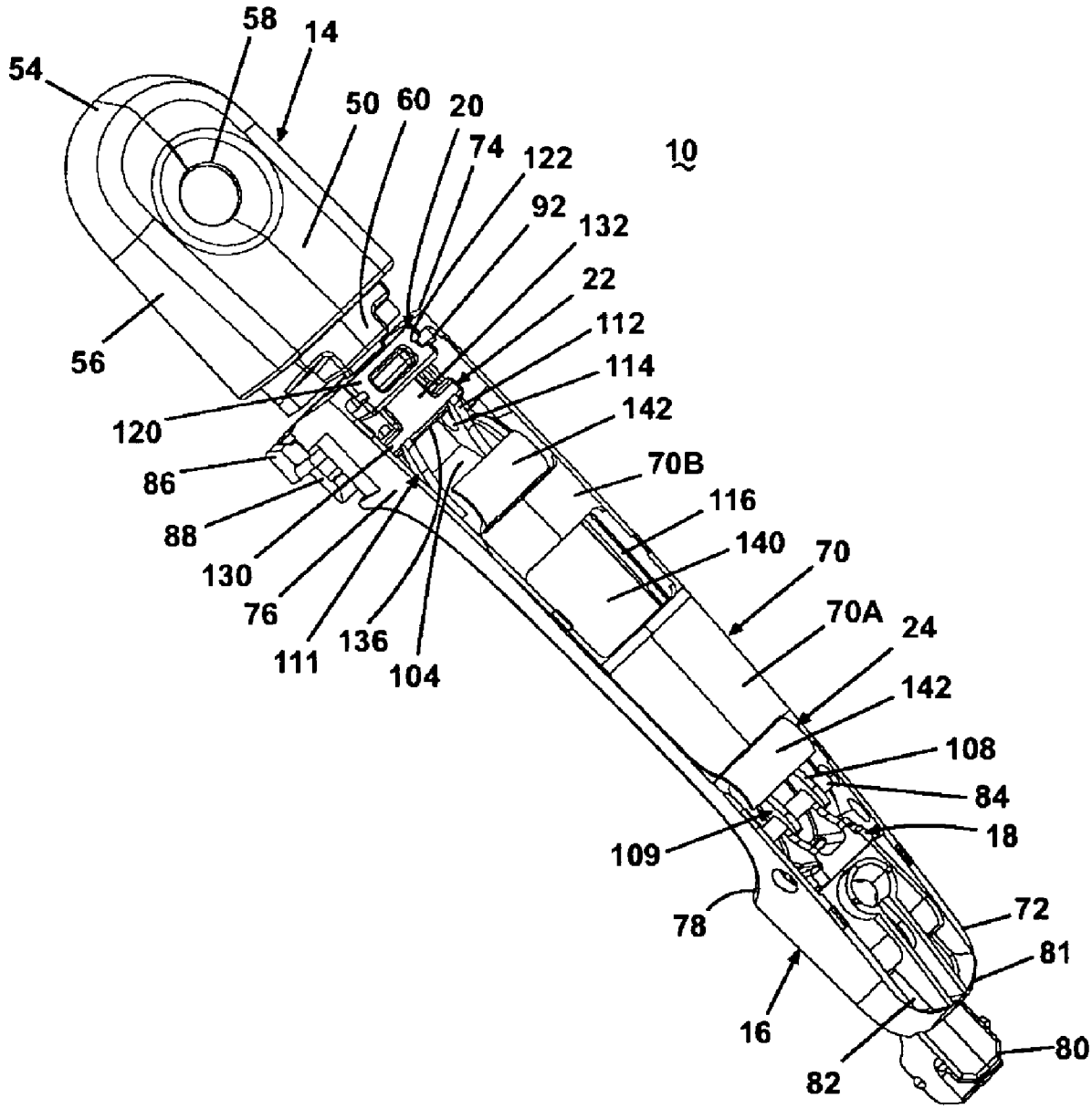
FIG. 2C is a perspective view of the vehicular door handle assembly shown in FIG. 1, wherein the handle grip is removed.

The manner in which the bearing 20 and the secondary latch 22 are mounted to the housing 16 is most easily seen in FIGS. 2C and 3. The bearing 20 is retained in the housing 16 by the interaction between the projections 92 in the housing 16 and the grooves 122 in the bearing 20. During assembly, the bearing 20 can be slid onto the projections 92 before the handle grip 12 is attached to the housing 12. Further, the bearing passageway 124 aligns with the secondary latch channel 62 of the end cap 14. The passageway 124 of the bearing 20 slidingly receives the latch body 132 to thereby support the secondary latch 22, and the flanges 130 of the secondary latch 22 are disposed within the housing 16. The secondary latch 22 is movable with respect the bearing 20. In particular, when the secondary latch 22 is in the active condition, the rearward end 134 protrudes beyond the bearing 20 and is received within the secondary latch channel 62 of the secondary latch receiver 60. When the secondary latch 22 is in the inactive condition, the rearward end 134 is shifted towards the bearing 20 such that it is no longer received by the secondary larch channel 62.

Referring again to FIGS. 1, 2A-2C, and 3, the trigger 18 is pivotally mounted to the housing 16 and operatively engages the secondary latch 22 to move the secondary latch 22 between the active and inactive conditions. The trigger 18 is positioned such that the crossbar 84 of the housing 16 sits in the channels 110 formed by the hooks 108 of the trigger mount 109, and the trigger 18 can pivot about an axis coincident with the crossbar 84. At the rearward end 104 of the trigger 18, the secondary latch mounts 111 project into the housing 16 at the rearward end 74 and slidingly receive the flanges 130 of the secondary latch 22. In particular, the grooves 114 between the arms 112 of the secondary latch mounts 111 slidingly receive the flanges 130 of the secondary latch 22. Because the trigger grip 100 is curved in accordance with the arcuate cutouts 38, 78 of the handle grip 12 and the housing 16, the trigger 18 essentially forms a lower wall for the handle grip 12 and the housing 16 and is therefore grasped by the user's hand when the user grasps the handle grip 12 and the housing 16 in a normal fashion.

The biasing member 24 is positioned between the trigger 18 and the upper wall 70 of the housing 16 to bias the trigger 18 away from the housing 16 to the secure position. The central portion 140 of the biasing member 24 abuts the trigger grip 100, and the curved ends 142 abut the edges of the forward segment 70A and rearward segment 70B, respectively, of the upper wall 70. The curved ends 142 exert an inward compressive force, and, thus, the interaction between the curved ends 142 and the upper wall 70 helps retain the biasing member 24 in place relative to the housing 16 and the trigger 18. The trigger 18 can pivot about the crossbar 84 and against the bias of the biasing member 24 towards the upper wall 70 to a release position. Movement of the trigger 18 to the release position corresponds to placing the secondary latch 22 in the inactive condition, as will be described in more detail hereinafter.

Figure 4:
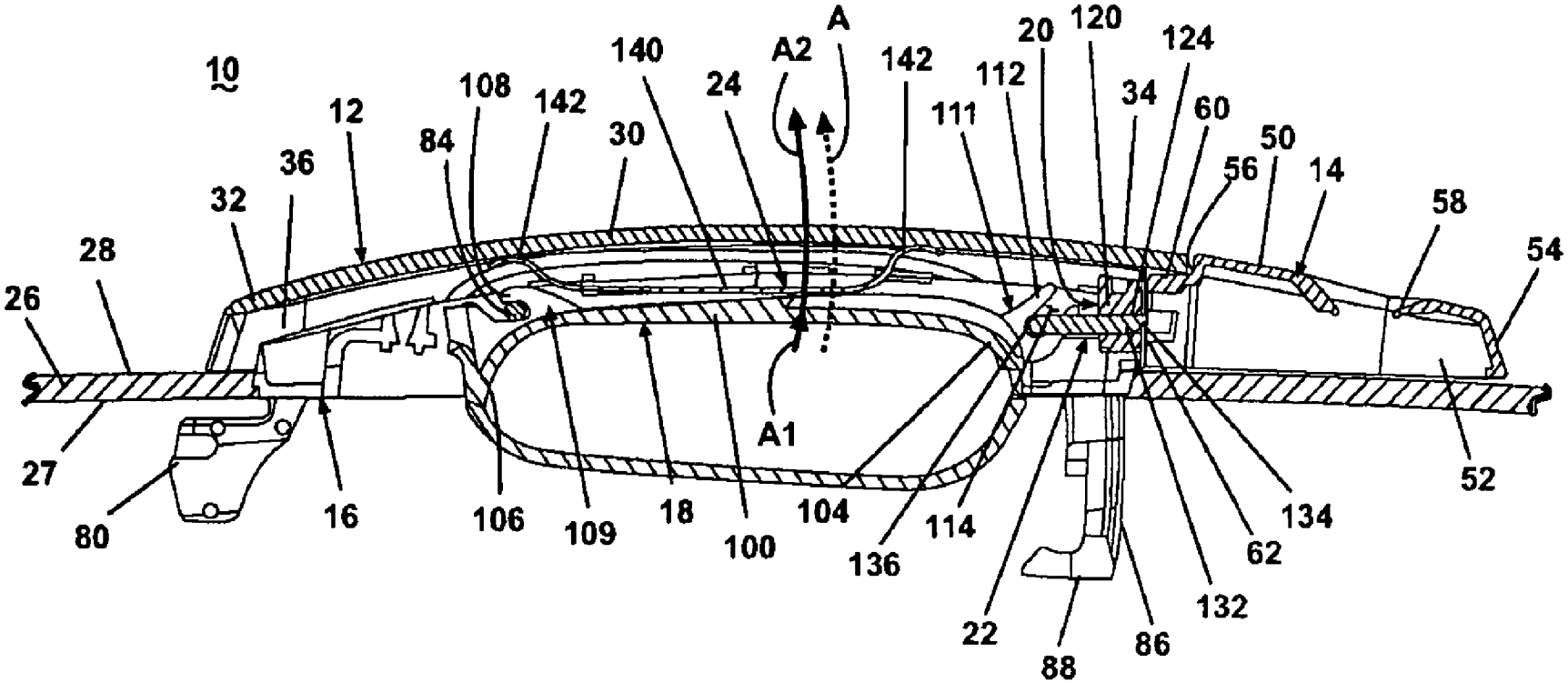
FIG. 4 is a sectional view similar to FIG. 3, wherein the secondary latch is in an inactive condition and the primary actuator is in the latched position.
Figure 5:
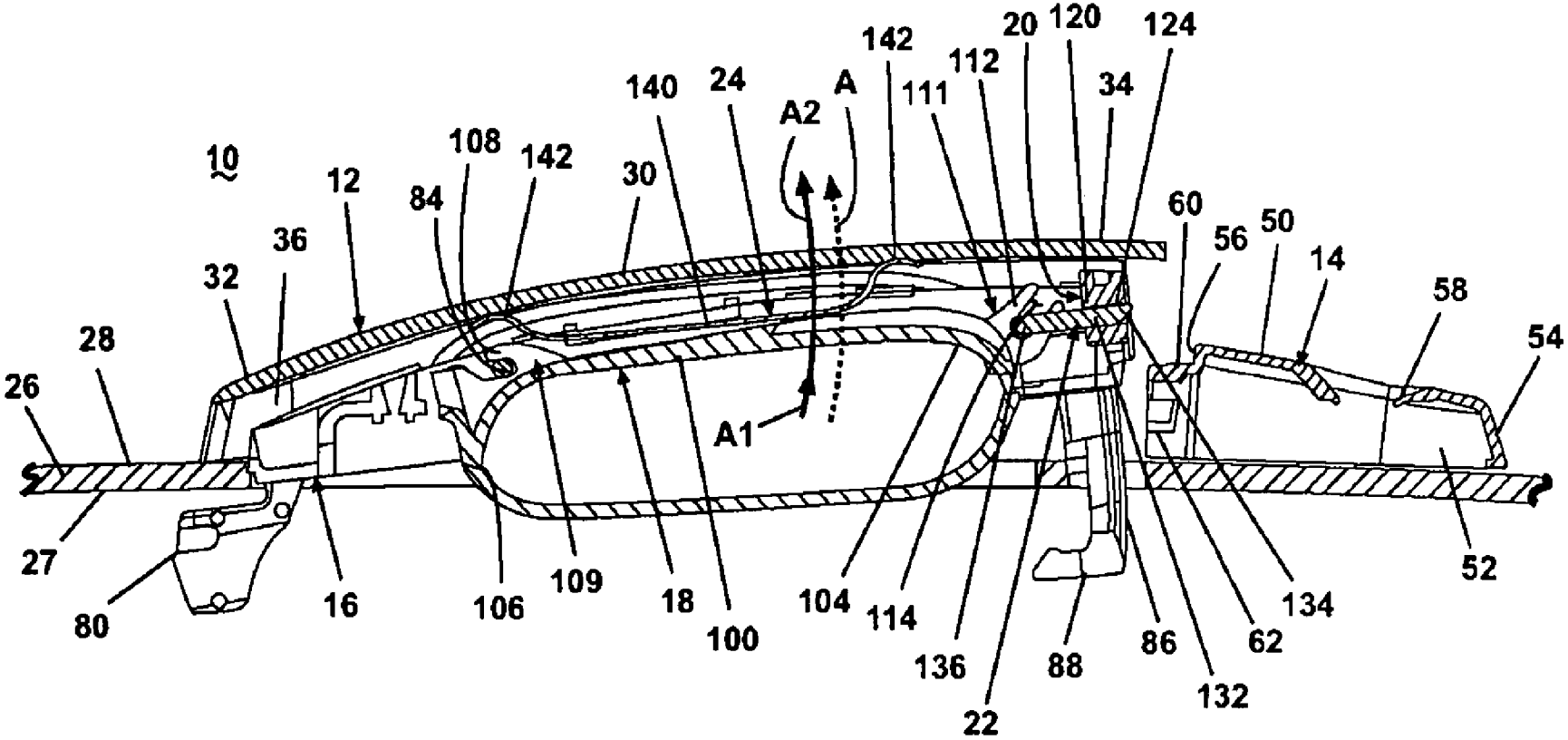
FIG. 5 is a sectional view similar to FIG. 4, wherein the secondary latch is in the inactive condition and the primary actuator is in an opened position.

The operation of the door handle assembly will be described with reference to FIGS. 3-5. The operation can essentially be characterized as having three stages: a first stage shown in FIG. 3 wherein the secondary latch 22 is in the active condition and the primary actuator is in the latched position, a second stage shown in FIG. 4 wherein the secondary latch 22 is in the inactive condition and the primary actuator is in the latched position, and a third stage shown in FIG. 5 wherein the secondary latch 22 is in the inactive condition and the primary actuator is in the opened position.

During the first stage, which corresponds to when the door is closed and unaffected by the user, such as when the vehicle is in motion, the housing 16 is aligned with the end cap 14 so that the passageway 124 in the bearing 20 is aligned with the secondary latch channel 62 in the secondary latch receiver 60. The biasing member 24 biases the trigger 18 away from the handle grip 12 to the secure position. The grooves 114 between the arms 112 of the secondary latch mounts 111 slidingly receive the flanges 130 of the secondary latch 22. Because the arms 112 and the grooves 114 are inclined, the position of the trigger 18 relative to the housing 16 determines the rearward/forward position of the secondary latch 22 relative to the housing 16 and the secondary latch receiver 60. When the trigger 18 is in the secure position, the trigger 18 forces the secondary latch 22 rearward to the active condition wherein the rearward end 134 of the latch body 132 resides in the secondary latch channel 62. Forward movement of the secondary latch 22 is prevented by the arms 122 of the secondary latch mounts 111. When the secondary latch 22 is in the active condition, the housing 16 cannot move relative to the end cap 14 or the door panel 26; therefore, the door handle assembly 10 cannot pivot about the pivot member 80. Hence, the primary actuator cannot be inadvertently moved to the opened position, and the door is prevented from undesirably opening. Due to the biasing member 24, the trigger 18 is normally in the secure position and, thus, the secondary latch 22 defaults to the active condition and will remain in the active condition until the user actuates the trigger 18.

When the user desires to open the vehicle door from the exterior side 28 of the door panel 26, the user grasps the handle grip 12 in a normal fashion, i.e., with the palm of the hand positioned against the upper wall 30 of the handle grip 12 and the fingers wrapped around the handle grip 12 and the housing 16 at the arcuate cutouts 38, 78. Because the trigger grip 100 is aligned with the arcuate cutouts 38, 78, the user also grasps the trigger 18 when the user grasps the handle grip 12 and the housing 16. The user then pulls on the door handle assembly 10 in a normal fashion, i.e., pulls the housing 16 and the handle grip 12 away from the door panel 26. Because the trigger 18 is coincident with the arcuate cutouts 38, 78, the user also pulls on the trigger 18 when pulling the door handle assembly 10 in a normal fashion. During this movement, the door handle assembly 10 seamlessly transitions through the second and third stages. In the second stage, the user pivots the trigger 18 against the bias of the biasing member 24 and towards the upper wall 70 of the housing 16 to the release position. Because the arms 112 and grooves 114 are inclined, the trigger 18 pulls the secondary latch 22 forward to the inactive condition wherein the rearward end 134 no longer resides in the secondary latch channel 62, as shown in FIG. 4. Once the secondary latch 22 is in the inactive condition, the user can continue to pull on the handle grip 12 and the housing 16 to pivot the door handle assembly 10 about the pivot member 80 to the opened position, as shown in FIG. 5 (the third stage), and thereby open the vehicle door. Because the trigger 18 is actuated as the user grasps the door handle assembly 10 in a normal fashion, the user can inactivate the secondary latch 22 and move the primary actuator to the opened position in effectively the same motion of the hand and, advantageously, does not have to conduct a series of discernibly discrete steps to open the door.

During the process of opening the door, the primary actuator and the secondary actuator move through an actuation path A. The actuation path A comprises a first portion A1, which corresponds to the movement from the first stage to the second stage, and a second portion A2, which corresponds to the movement from the second stage to the third stage. The actuation path A and the first and second portions A1, A2 thereof for this embodiment are shown schematically in FIG. 3. As seen in this figure, the first and second portions A1, A2 are serially aligned, i.e., they occur one after another without an interruption therebetween, such that the transition from the first portion A1 to the second portion A2 is substantially indistinguishable to the user as the user moves the primary actuator and the secondary actuator through the actuation path.

The primary actuator and the secondary actuator can also be thought of as having a common actuation path A. In other words, the actuation path that the secondary actuator moves through to move from the secure position to the release position lies on the same trajectory as the actuation path that the primary actuator moves through to move from the latched position to the opened position. Hence, the primary and secondary actuators share a common actuation path A, and, when the user grasps the primary actuator and the secondary actuation to open the door, the user senses only a single movement through the common actuation path A. Depending on the type of the door handle assembly 10, the common actuation path A can be arcuate, as in FIG. 3, or linear.

After the door is opened, the user releases the housing 16 and handle grip 12 and, thus, the trigger 18, which moves away from the housing 16 under the force of the biasing member 24. As a result, the secondary latch 22 shifts rearward while the housing 16 pivots towards the door panel 26 under the force of a counterweight (not shown). When the rearward end 134 of the latch body 132 abuts the secondary latch receiver 60, the secondary latch 132 temporarily retracts forward, due to the tapered shape of the rearward end 134, until the latch body 132 aligns with the secondary latch channel 62. Once the latch body 132 and the secondary latch channel 62 are aligned, the trigger 18 forces the secondary latch 22 to the active condition to prevent inadvertent movement of the door handle assembly 10 to the opened position, as described above for the first stage.

A second embodiment vehicular door handle assembly 200 according to the invention is shown schematically in FIGS. 6-9, where components similar to those in the first embodiment are identified with the same reference numeral. The second embodiment door handle assembly 200 is a paddle-type handle comprising a housing 16, a paddle handle grip 12 integral with the housing 16 to form a primary actuator, and a secondary actuator in the form of a trigger 18 pivotally mounted to the paddle handle grip 12 and having an integral secondary latch 22. The housing 16 further comprises a substantially C-shaped pivot member 80 and a substantially Z-shaped primary latch actuator 86, wherein each has a pivot connection 202 for pivotally mounting the door handle assembly 200 within the door. The primary latch actuator 86 also includes a primary latch actuating arm 88 that is in operative communication with a primary latch (not shown) for moving the primary latch between latched and opened states, as described above for the first embodiment. The secondary latch 22, which is movable with the trigger 18 with respect to the paddle handle grip 12, comprises an elongated arm 204 and a detent in the form of a terminal hook 206.

Figure 7:
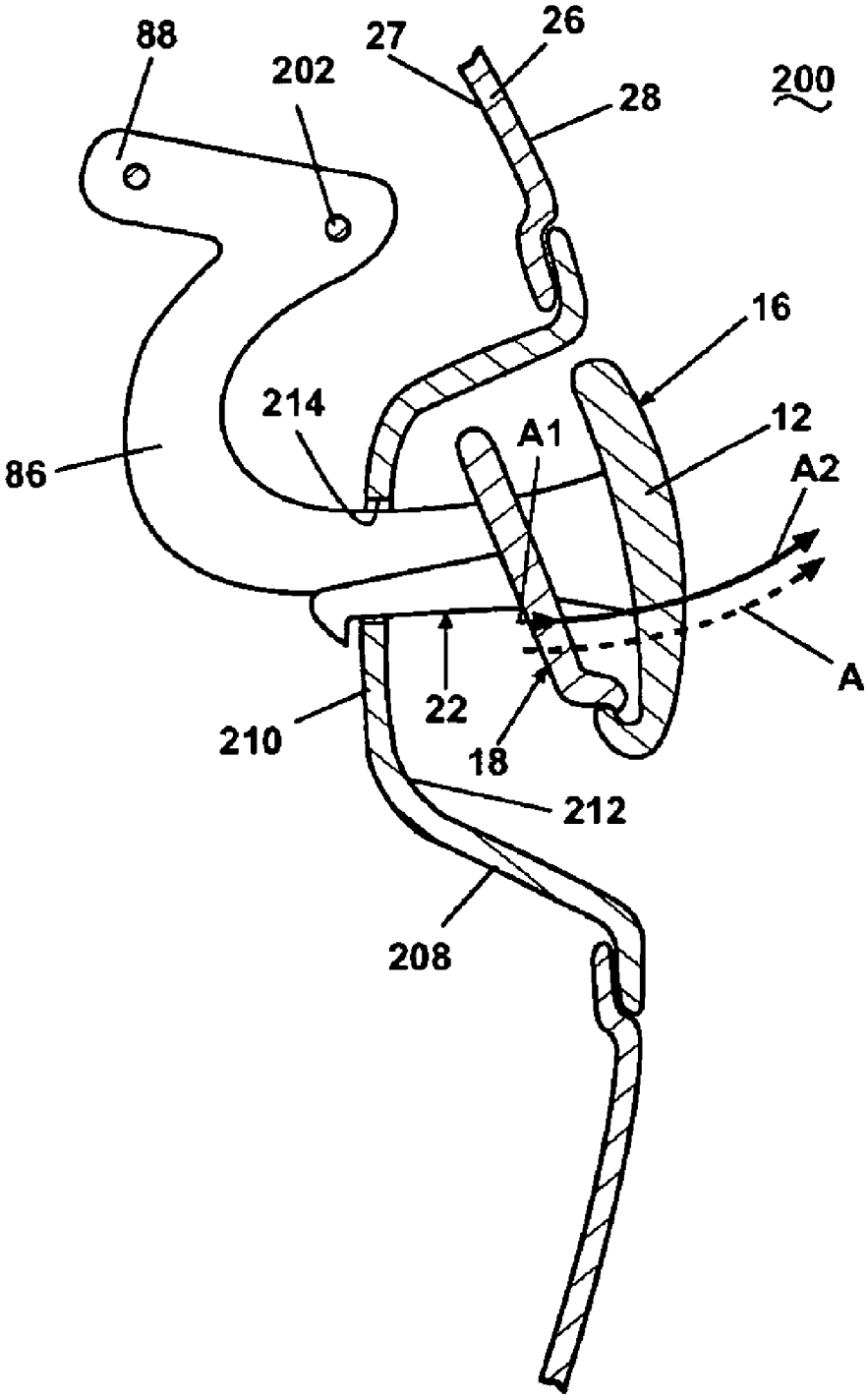
FIG. 7 is a schematic sectional view of the vehicular door handle assembly shown in FIG. 6, wherein the secondary latch is in an active condition and the primary actuator is in a latched position.

As seen in FIG. 7, the door handle assembly 200 further comprises an escutcheon plate 208 mounted to the door panel 26 to cover an opening therein. The escutcheon plate 208 has an interior side 210, an exterior side 212, and a central aperture 214. When the door handle assembly 200 is mounted to the door panel 26, the housing 16 is positioned such that the paddle handle grip 12 and the trigger 18 are on the exterior side 212 of the escutcheon plate 208, and the pivot member 80, the primary latch actuator 86, and the secondary latch 22 extend through the aperture 214 to the interior side 210 of the escutcheon plate 208. Preferably, the paddle handle grip 12 lies in the same plane as the door panel 26 for aerodynamic and aesthetic purposes. Alternatively, the escutcheon plate 208 can be an integral part of the door panel 26.

With continued reference to FIG. 7, a biasing member (not shown) biases the trigger 18 to a secure position, which corresponds to an active condition for the secondary latch 22. In the active condition, the terminal hook 206 abuts the exterior side 212 of the escutcheon plate 208 to preclude pivotal movement of the housing 16 about the pivot connections 202 and thereby prevent inadvertent movement of the primary actuator from a latched position to an opened position, such as during an impact. Similar to the first embodiment, the user can move the trigger 18 to a release position that corresponds to an inactive condition for the secondary latch 22 for enabling movement of the primary actuator to the opened position, as will be described in more detail hereinafter.

Figure 8:
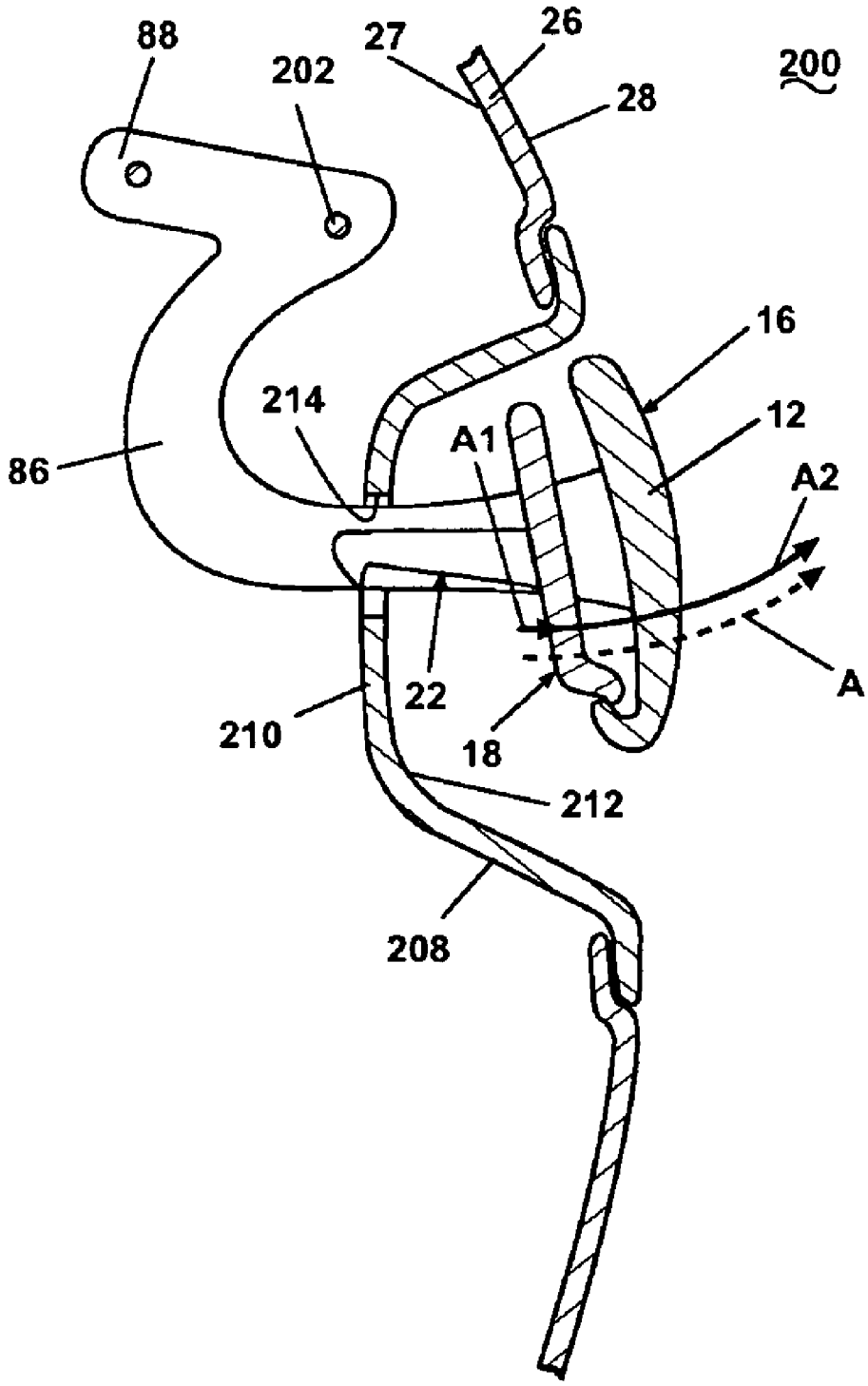
FIG. 8 is a schematic sectional view similar to FIG. 7, wherein the secondary latch is in an inactive condition and the primary actuator is in the latched position.
Figure 9:
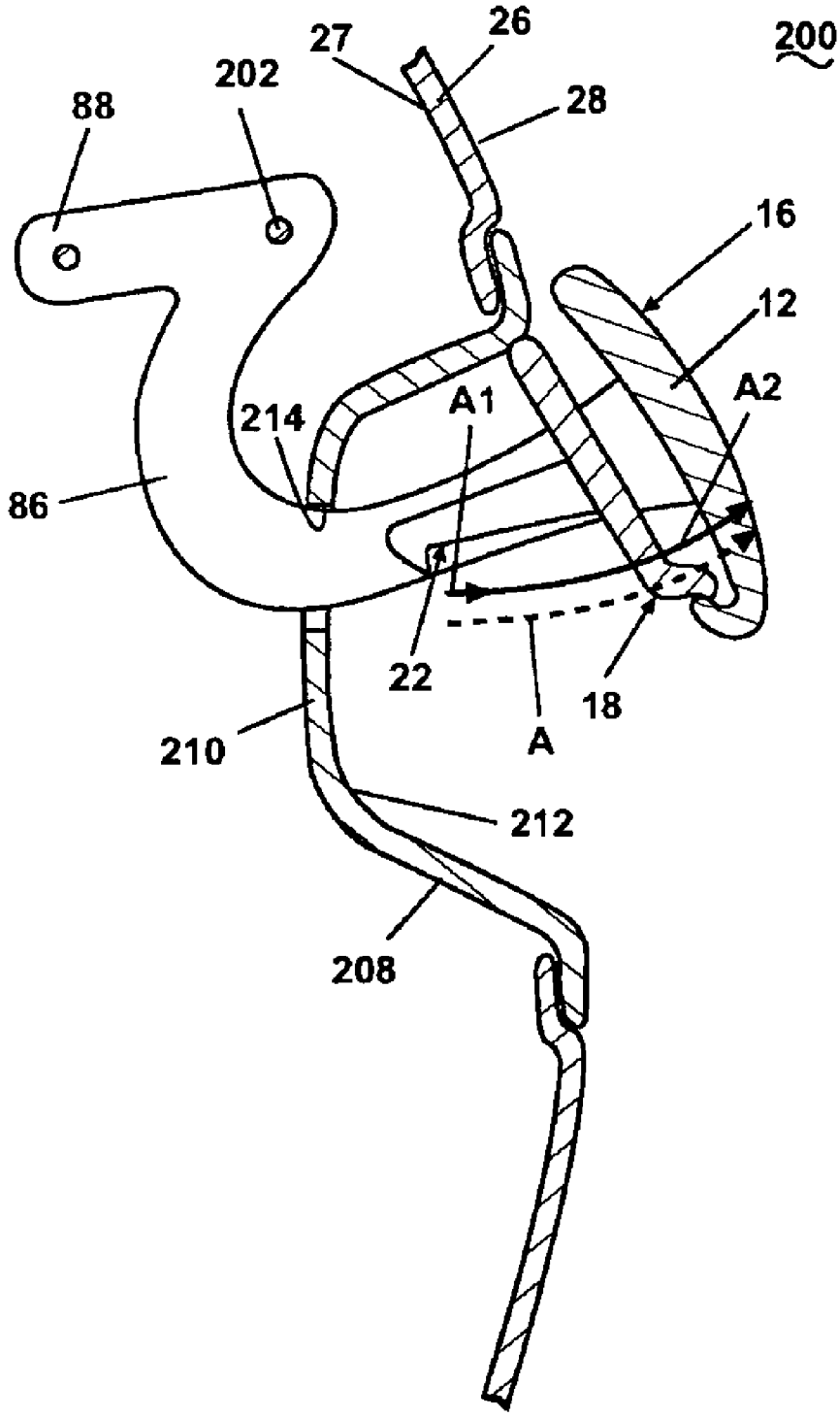
FIG. 9 is a schematic sectional view similar to FIG. 8, wherein the secondary latch is in the inactive condition and the primary actuator is in an opened position.

As described previously with respect to the first embodiment, the operation of the door handle assembly 200 can essentially be characterized as having three stages: a first stage shown in FIG. 7 wherein the secondary latch 22 is in the active condition and the primary actuator is in the latched position, a second stage shown in FIG. 8 wherein the secondary latch 22 is in the inactive condition and the primary actuator is in the latched position, and a third stage shown in FIG. 9 wherein the secondary latch 22 is in the inactive condition and the primary actuator is in the opened position. In the first stage, wherein the door handle assembly 200 is at rest, the terminal hook 206 of the secondary latch 22 abuts the exterior side 212 of the escutcheon plate 208. When the user desires to open the door, the user reaches behind the paddle handle grip 12, as is conventional for a paddle-type vehicular door handle, and simultaneously grasps the paddle handle grip 12 and the trigger 18 and thereby pivots the trigger 18 toward the paddle handle grip 12 to move the secondary latch 22 to the inactive condition, as shown in FIG. 8. As the trigger 18 pivots to the release position, the terminal hook 206 also pivots such that it no longer abuts the exterior side 212 of the escutcheon plate 208 and is aligned with the aperture 214. The user then easily transitions from the second stage to the third stage by continuing to grasp the paddle handle grip 12 and the trigger 18 and pulling on the door handle assembly 200 to move the door handle assembly 200 to the opened position, as shown in FIG. 9.

Figure 10:
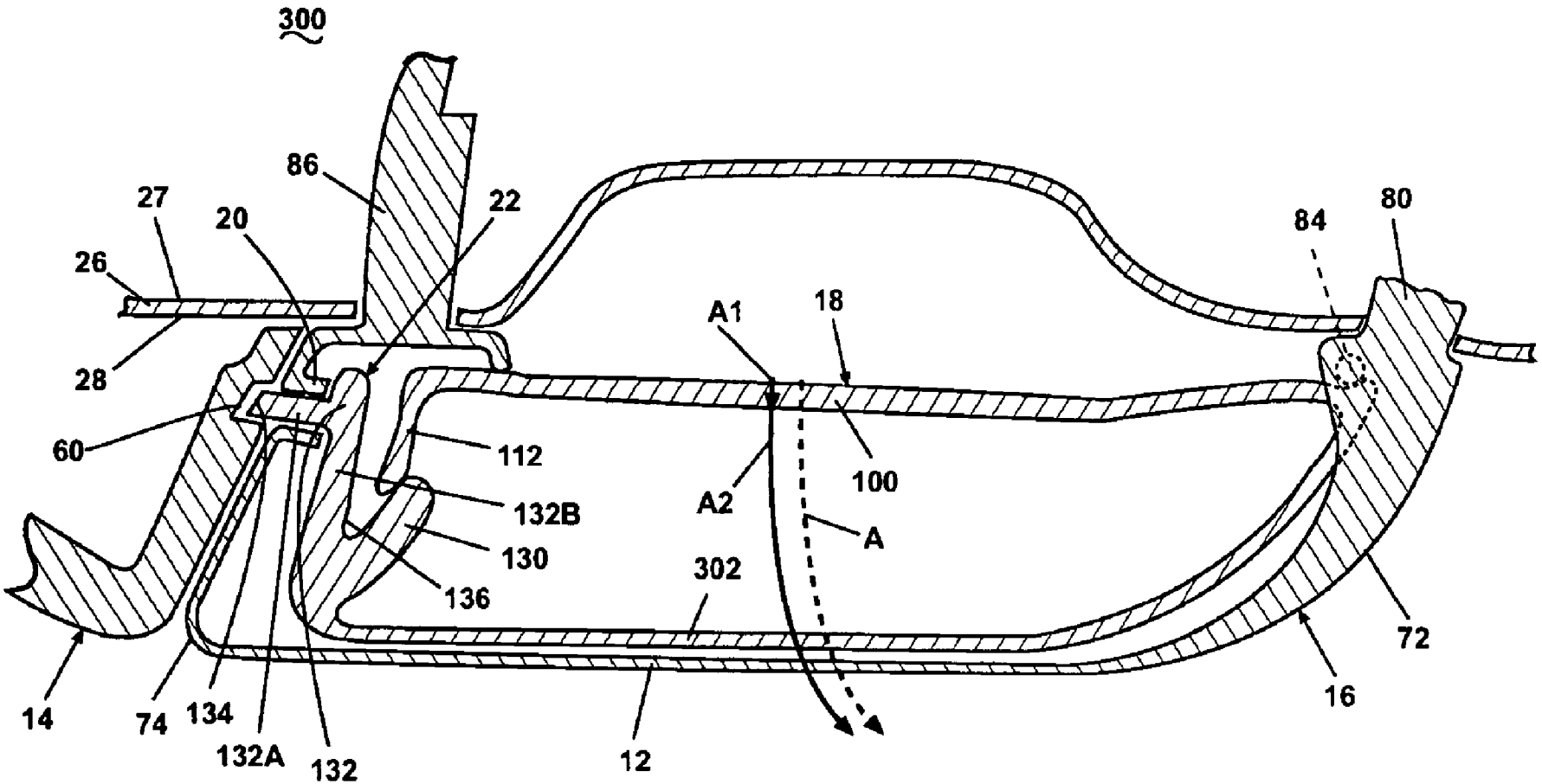
FIG. 10 is a schematic sectional view of a third embodiment vehicular door handle assembly according to the invention, wherein the secondary latch is in an active condition and the primary actuator is in a latched position.
Figure 11:
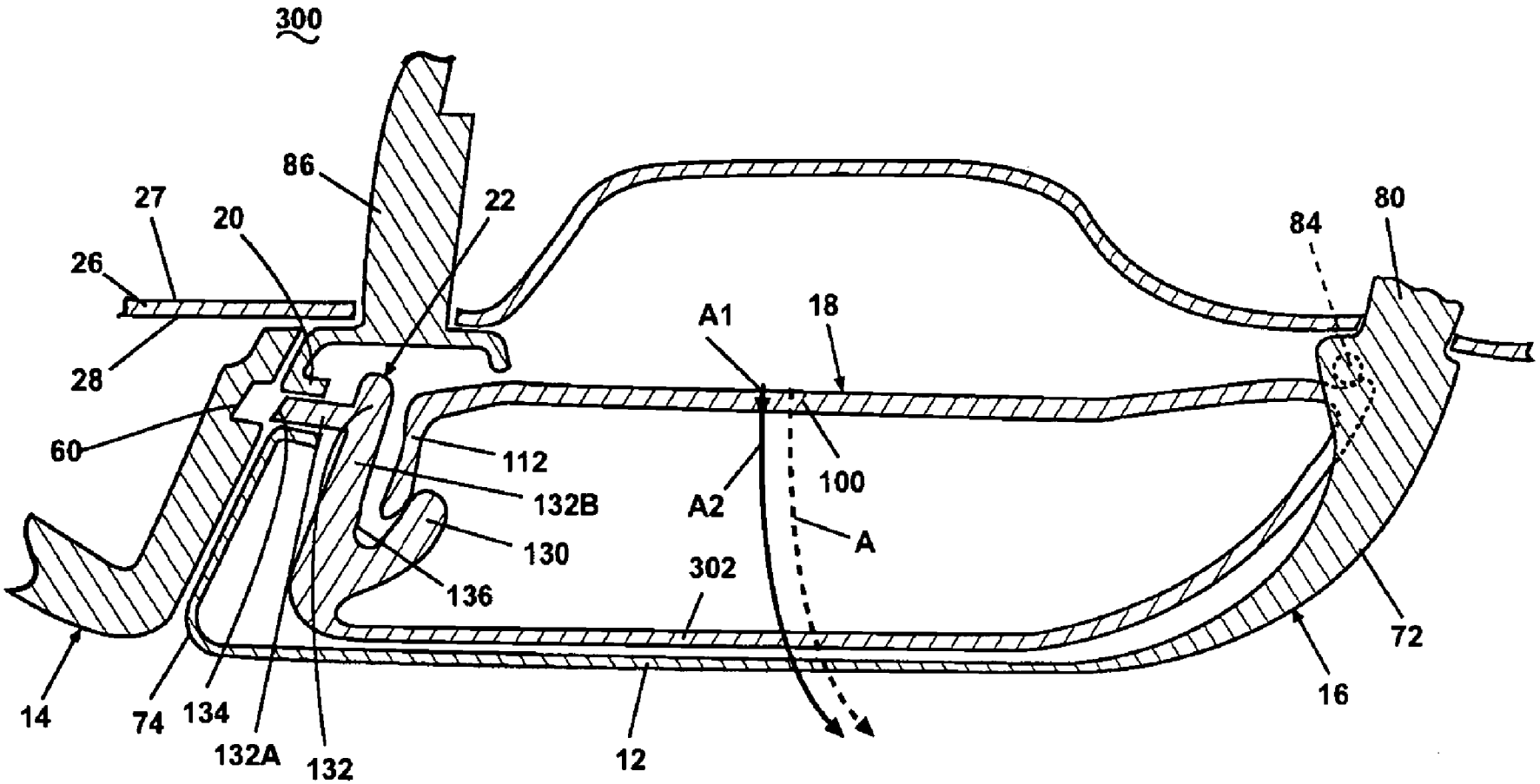
FIG. 11 is a schematic sectional view similar to FIG. 10, wherein the secondary latch is in an inactive condition and the primary actuator is in the latched position.
Figure 12:
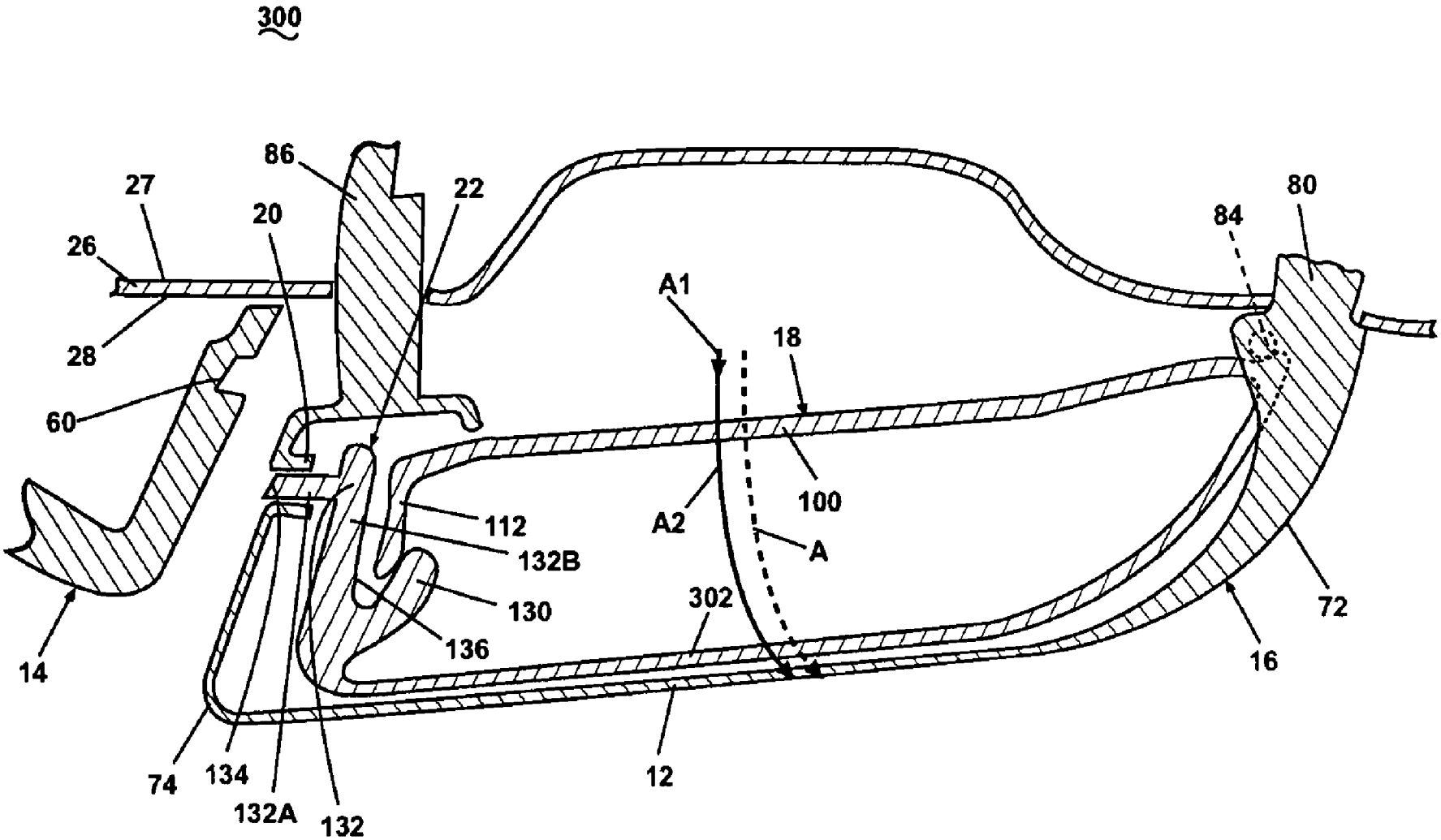
FIG. 12 is a schematic sectional view similar to FIG. 11, wherein the secondary latch is in the inactive condition and the primary actuator is in an opened position.

A third embodiment vehicular door handle 300 according to the invention is schematically illustrated in FIGS. 10-12, where components similar to those in the previous embodiments are identified with the same reference numeral. The third embodiment door handle assembly 300 comprises a housing 16, a handle grip 12 integral with the housing 16 to form a primary actuator, a secondary actuator in the form of a unitary trigger 18 and secondary latch 22 mounted to the housing 16, and an end cap 14 having a secondary latch receiver 60. Similar to the first embodiment, the housing 16 includes, at a forward end 72, a pivot member 80 and, a rearward end 74, a primary latch actuator 86 that extend through apertures in the door panel 26 to reside on the interior side 27 of the door panel 26. The pivot member 80 pivotally couples the door handle assembly 300 within the door, and the primary latch actuator 86 operatively communicates with a primary latch (not shown). The remaining components of the door handle assembly 300 are located on the exterior side 28 of the door panel 26. The housing 16 further comprises a crossbar 84 at the forward end 72 for pivotally coupling the unitary trigger 18 and secondary latch 22 to the housing 16 and a bearing 20 at the rearward end 74 for guiding movement of the secondary latch 22.

The unitary trigger 18 and secondary latch 22 is mounted within the housing 16 and comprises a trigger grip 100 that terminates in a generally perpendicular arm 112 at one end and joins at the other end with a trigger support 302 having a length substantially equal to that of the handle grip 12. At its other end, the trigger support 302 joins with the secondary latch 22. The secondary latch 22 comprises an L-shaped latch body 132 having a first portion 132A with a tapered rearward end 134 and a second portion 132B with an integral flange 130 at a forward end 136. When the unitary trigger 18 and secondary latch 22 is mounted to the housing 16, the bearing 20 slidingly receives the first portion 132A of the latch body 132, and the arm 112 abuts the flange 130. The unitary trigger 18 and secondary latch 22 pivotally couple with the crossbar 84 near the juncture of the trigger grip 100 with the trigger support 302.

The unitary trigger 18 and secondary latch 22 is at least partially composed of a resilient or spring-like material such that the trigger grip 100 is biased away from the trigger support 302, and the secondary latch 22 is biased into the secondary latch receiver 60, as shown in FIG. 10. Interaction between the arm 112 and the flange 130 controls the position of the secondary latch 22, and the housing 16 limits movement of the trigger grip 100 towards the door panel 26. Movement of the trigger grip 100 towards the trigger support 302, such as when the door handle assembly 300 is grasped by the user, induces pivotal movement of the secondary latch 22 away from the secondary latch receiver 60, as shown in FIG. 11.

As described previously with respect to the first and second embodiments, the operation of the door handle assembly 300 can essentially be characterized as having three stages: a first stage shown in FIG. 10 wherein the secondary latch 22 is in an active condition and the primary actuator is in a latched position, a second stage shown in FIG. 11 wherein the secondary latch 22 is in an inactive condition and the primary actuator is in the latched position, and a third stage shown in FIG. 12 wherein the secondary latch 22 is in the inactive condition and the primary actuator is in an opened position. In the first stage, the rearward end 124 of the secondary latch 22 is biased into the secondary latch receiver 60 and, therefore, prevents movement of the housing 16 away from the door panel 26. Hence, because the secondary latch 22 is in the active condition, the door handle assembly 300 cannot pivot from the latched position to open the door.

When the user desires to open the door, the user grasps the door handle assembly 300 in a normal fashion, i.e., with the palm of the hand positioned against the handle grip 12 and the fingers wrapped around the trigger grip 100. The user then pulls on the door handle assembly 300 in a normal fashion, i.e., pulls the housing 16 and the handle grip 12 away from the door panel 26. Due to the position of the trigger grip 100, the user also pulls the trigger grip 100 towards the trigger support 302, as indicated by the arrow in FIG. 11, when the pulling the housing 16 and the handle grip 12 away from the door panel 26. During the second stage, the unitary trigger 18 and secondary latch 22 is essentially deformed as the trigger grip 100 pivots near the crossbar 84 and is displaced towards the trigger support 302. In turn, the arm 112 forces the secondary latch 22 to pivot about a point near the juncture of the secondary latch 22 and the trigger support 302, and, as a result, the secondary latch 22 moves to the inactive condition, wherein the rearward end 134 of the secondary latch 22 no longer resides within the secondary latch receiver 60. The third stage begins when the secondary latch 22 achieves the inactive condition, which enables the door handle assembly 300 to move to the opened position, as shown in FIG. 12, to thereby open the door. The transition from the second to the third stage occurs seamlessly and is relatively unnoticeable to the user.

Figure 13:
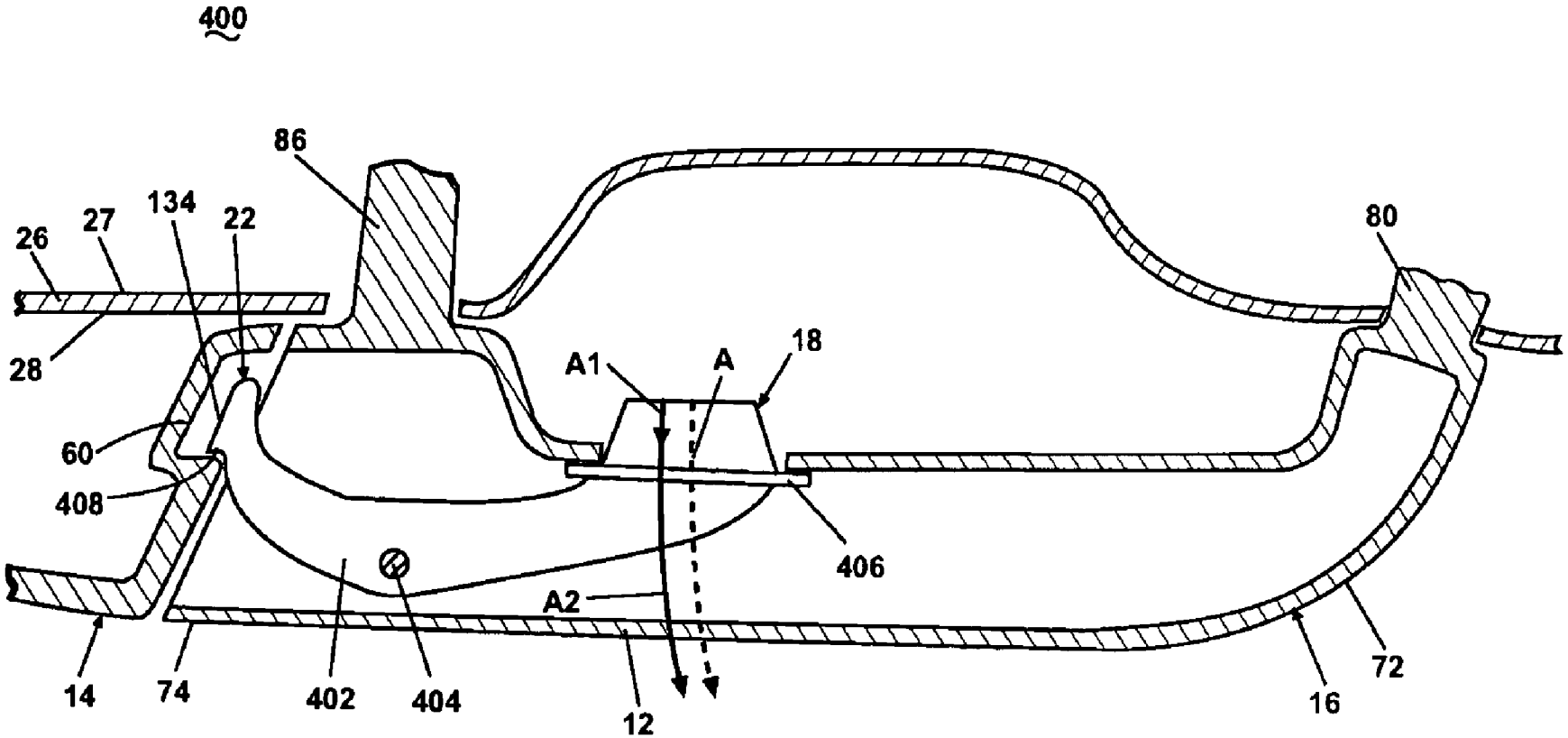
FIG. 13 is a schematic sectional view of a fourth embodiment vehicular door handle assembly according to the invention, wherein the secondary latch is in an active condition and the primary actuator is in a latched position.
Figure 14:
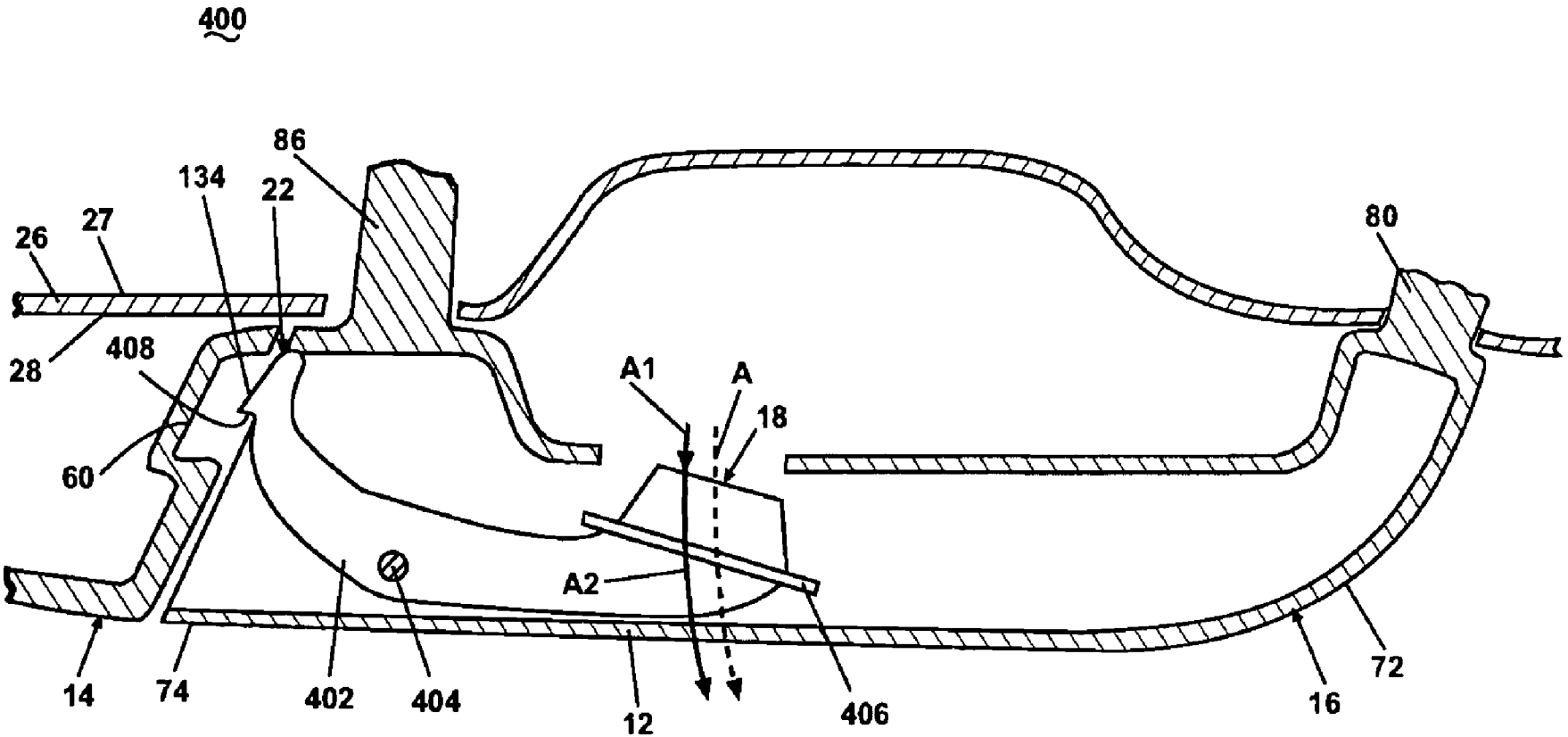
FIG. 14 is a schematic sectional view similar to FIG. 13, wherein the secondary latch is in an inactive condition and the primary actuator is in the latched position.
Figure 15:
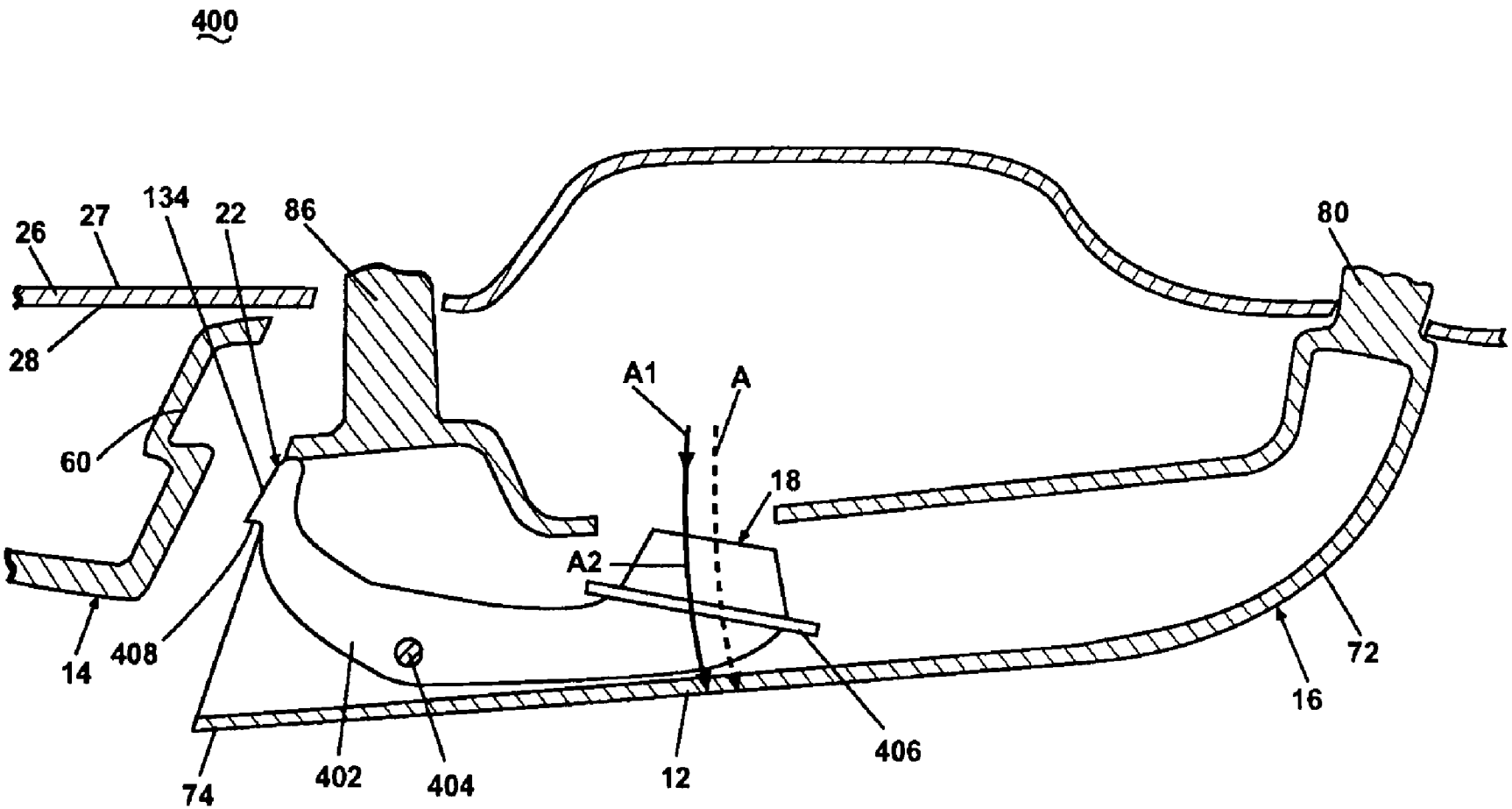
FIG. 15 is a schematic sectional view similar to FIG. 14, wherein the secondary latch is in the inactive condition and the primary actuator is in an opened position.

A fourth embodiment vehicular door handle 400 according to the invention is schematically illustrated in FIGS. 13-15, where components similar to those in the previous embodiments are identified with the same reference numeral. The fourth embodiment door handle assembly 400 is substantially identical to the third embodiment door handle assembly 300, except that the unitary trigger 18 and secondary latch 22, which forms the secondary actuator, comprises a pivot arm 402 that joins the trigger 18, which is in the form of a button, with the secondary latch 22, which includes a latch body 132 having a protruding rearward end 134 with a detent 408. The pivot arm 402 is disposed inside the housing 16 and pivots about a pivot pin 404. The unitary trigger 18 and secondary latch 22 is biased by a biasing member (not shown) into the position shown in FIG. 13. In this position, the rearward end 134 and detent 408 of the secondary latch 22 resides in the secondary latch receiver 60, and the trigger 18 projects out of the housing 16 and into the space between the housing 16 and the body panel 26. Further outward movement of the trigger 18 is prevented by an internal stop 406 located on the pivot arm 402. Movement of the trigger 18 towards the housing 16, such as when the door handle assembly 400 is grasped by the user, induces pivotal movement of the pivot arm 302 and, thus, the secondary latch 22. As a result, the secondary latch 22 pivots towards the door panel 26 and away from the secondary latch receiver 60, as shown in FIG. 14.

As described previously with respect to the first three embodiments, the operation of the door handle assembly 400 can essentially be characterized as having three stages: a first stage shown in FIG. 13 wherein the secondary latch 22 is in an active condition and the primary actuator is in a latched position, a second stage shown in FIG. 14 wherein the secondary latch 22 is in an inactive condition and the primary actuator is in the latched position, and a third stage shown in FIG. 15 wherein the secondary latch 22 is in the inactive condition and the primary actuator is in an opened position. In the first stage, the rearward end 124 and detent 408 of the secondary latch 22 is biased into the secondary latch receiver 60 and, therefore, prevents movement of the housing 16 away from the door panel 26. Hence, because the secondary latch 22 is in the active condition, the door handle assembly 400 cannot pivot from the latched position to open the door.

When the user desires to open the door, the user grasps the door handle assembly 400 in a normal fashion, i.e., with the palm of the hand positioned against the handle grip 12 and the fingers wrapped around the housing 16. The user then pulls on the door handle assembly 400 in a normal fashion, i.e., pulls the housing 16 and the handle grip 12 away from the door panel 26. Due to the position of the trigger 18, the user also depresses the trigger 18 towards the handle grip 12, as indicated by the arrow in FIG. 14, when the pulling the housing 16 and the handle grip 12 away from the door panel 26. During the second stage, depression of the trigger 18 pivots the pivot arm 402 about the pivot pin 404 and, in turn, forces the secondary latch 22 to move to the inactive condition, wherein the rearward end 134 and detent 408 of the secondary latch 22 no longer resides within the secondary latch receiver 60, as shown in FIG. 14. The third stage begins when the secondary latch 22 achieves the inactive condition, which enables the door handle assembly 400 to move to the opened position, as shown in FIG. 15, to thereby open the door. The transition from the second to the third stage occurs seamlessly and is relatively unnoticeable to the user.

Figure 16:
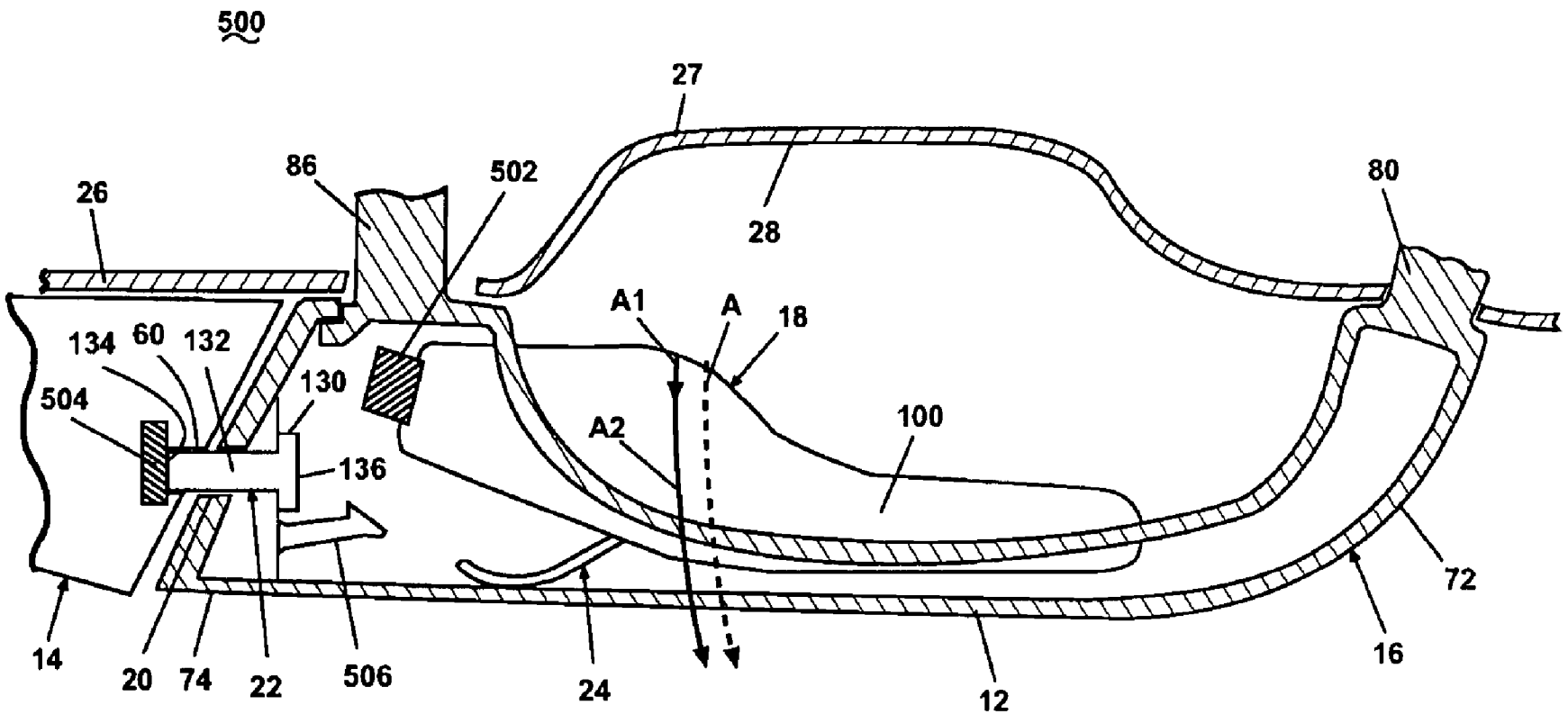
FIG. 16 is a schematic sectional view of a fifth embodiment vehicular door handle assembly according to the invention, wherein the secondary latch is in an active condition and the primary actuator is in a latched position.
Figure 17:
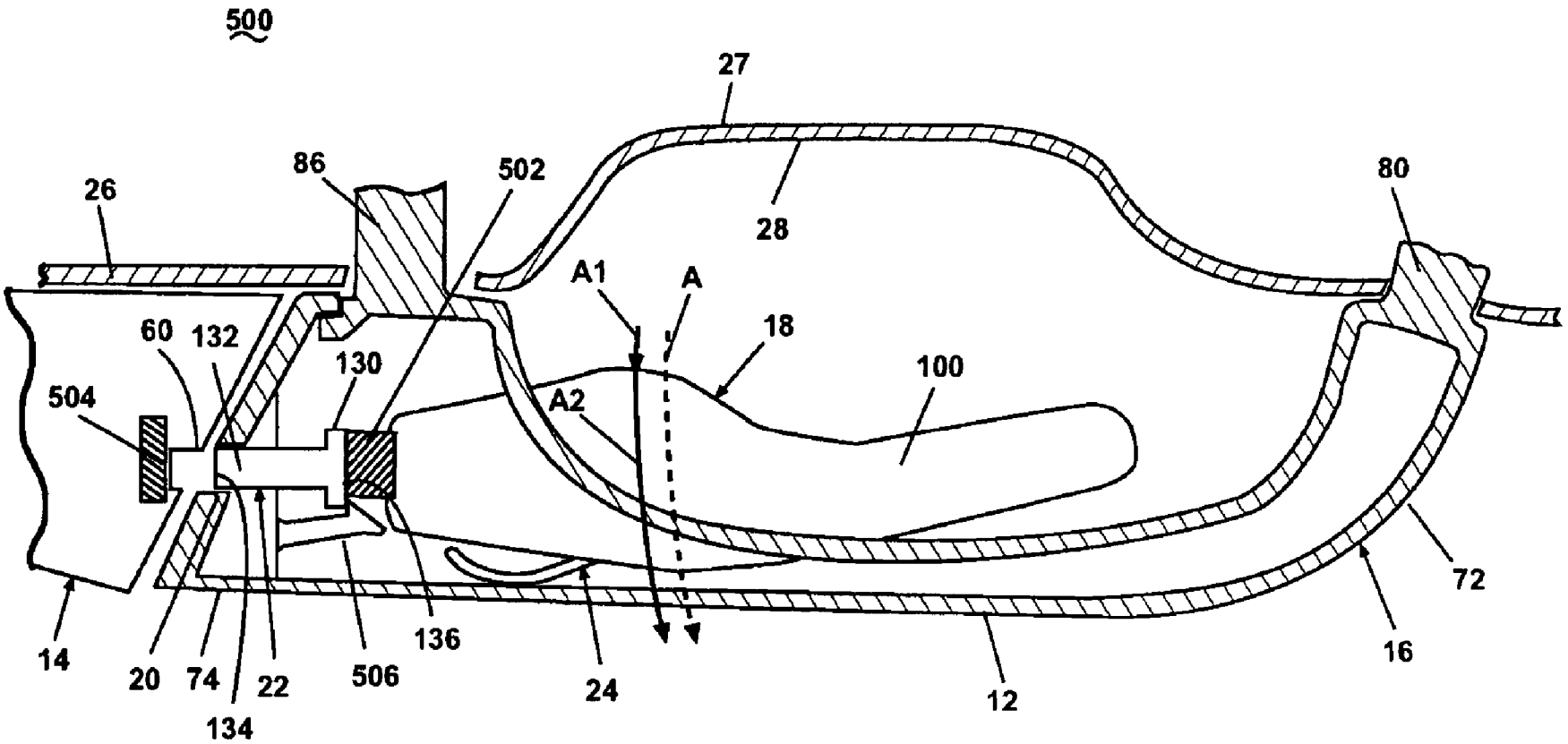
FIG. 17 is a schematic sectional view similar to FIG. 16, wherein the secondary latch is in an inactive condition and the primary actuator is in the latched position.
Figure 18:
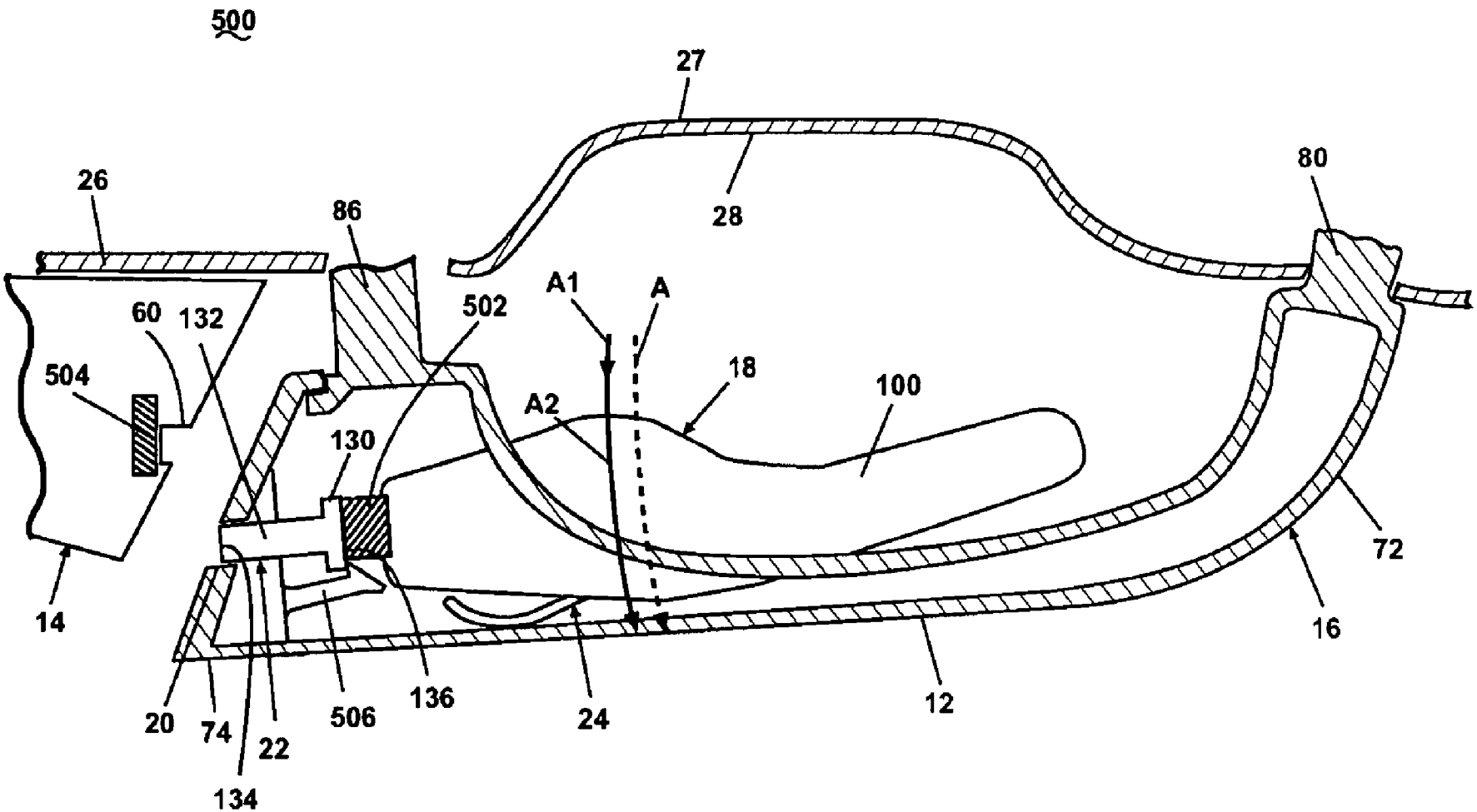
FIG. 18 is a schematic sectional view similar to FIG. 17, wherein the secondary latch is in the inactive condition and the primary actuator is in an opened position.

A fifth embodiment vehicular door handle 500 according to the invention is schematically illustrated in FIGS. 16-18, where components similar to those in the previous embodiments are identified with the same reference numeral. The fifth embodiment door handle assembly 500 comprises a housing 16, a handle grip 12 integral with the housing 16 to form a primary actuator, a secondary actuation in the form of a trigger 18 movably mounted to the housing 16, a secondary latch 22 movably mounted to the housing 16 and in operative communication with the trigger 18, and an end cap 14 having a secondary latch receiver 60. Similar to most of the previous embodiments, the housing 16 includes, at a forward end 72, a pivot member 80 and, a rearward end 74, a primary latch actuator 86 that extend through apertures in the door panel 26 to reside on the interior side 27 of the door panel 26. The pivot member 80 pivotally couples the door handle assembly 500 within the door, and the primary latch actuator 86 operatively communicates with a primary latch (not shown). The remaining components of the door handle assembly 500 are located on the exterior side 28 of the door panel 26. The housing 16 further comprises a bearing 20 at the rearward end 74 for guiding movement of the secondary latch 22 and an internal stop 506 for limiting forward movement of the secondary latch 22.

The trigger 18 comprises an elongated, arcuate trigger grip 100 that is biased away from the handle grip 12 by a biasing member 24, such as a leaf spring, and includes a trigger magnet 502, which is preferably a permanent magnet, such as a rare earth magnet, fixed to a rearward end of the trigger grip 100. The trigger 18 is movable towards the handle grip 12 and against the bias of the biasing member 24 to align the trigger magnet 502 with the secondary latch 22.

Similar to the trigger 18, the secondary latch receiver 60 in the end cap 14 comprises a secondary latch receiver magnet 504, which is also preferably a permanent magnet, such as a rare earth magnet. The secondary latch receiver magnet 504 is a latch biasing member that biases the secondary latch 22 into the secondary latch receiver 60. However, the secondary latch receiver magnet 504 is smaller than the trigger magnet 502 so that the magnetic field of the latter is greater than that of the former; therefore, the trigger magnet 502 will draw the secondary latch 22 away from the secondary latch receiver magnet 504 when aligned with the secondary latch 22. Preferably, the size of the secondary latch receiver magnet 504 is about one third the size of the trigger magnet 502.

The secondary latch 22 is movably mounted within the bearing 20 of the housing 16 and comprises a latch body 132 with a rearward end 134, a forward end 136, and flanges 130 at the forward end 136. The secondary latch 22 is composed of a magnetic material and is, therefore, attracted to the trigger magnet 502 and the secondary latch receiver magnet 504. The position of the secondary latch 22 is determined by the location of the trigger magnet 502. When the trigger magnet 502 is not aligned with the secondary latch 22, the secondary latch 22 defaults to an active condition, shown in FIG. 16, wherein the secondary latch 22 is received by the secondary latch receiver 60, and the rearward end 134 abuts the secondary latch receiver magnet 504. However, when the trigger magnet 502 aligns with the secondary latch 22, its magnetic field draws the secondary latch 22 out of the secondary latch receiver 60 and towards the trigger magnet 502 to an inactive condition. The stop 506 limits the forward displacement of the secondary latch 22 and the movement of the trigger magnet 502 towards the handle grip 12.

As described with respect to the previous embodiments, the operation of the door handle assembly 500 can essentially be characterized as having three stages: a first stage shown in FIG. 16 wherein the secondary latch 22 is in the active condition and the primary actuator is in a latched position, a second stage shown in FIG. 17 wherein the secondary latch 22 is in the inactive condition and the primary actuator is in the latched position, and a third stage shown in FIG. 18 wherein the secondary latch 22 is in the inactive condition and the primary actuator is in an opened position. In the first stage, the rearward end 124 of the secondary latch 22 is drawn into the secondary latch receiver 60 by the secondary latch receiver magnet 504 and, therefore, prevents movement of the housing 16 away from the door panel 26. Hence, because the secondary latch 22 is in the active condition, the door handle assembly 500 cannot pivot from the latched position to open the door.

When the user desires to open the door, the user grasps the door handle assembly 500 in a normal fashion, i.e., with the palm of the hand positioned against the handle grip 12 and the fingers wrapped around the housing 16. The user then pulls on the door handle assembly 500 in a normal fashion, i.e., pulls the housing 16 and the handle grip 12 away from the door panel 26. Due to the position of the trigger 18, the user also pulls the trigger grip 100 towards the handle grip 12 and against the bias of the biasing member 24. During the second stage, pulling the trigger 18 aligns the trigger magnet 502 with the secondary latch 22. Because the trigger magnet 502 is stronger than the secondary latch receiver magnet 504, the secondary latch 22 moves towards the trigger magnet 502 to the inactive condition, wherein the rearward end 134 of the secondary latch 22 no longer resides within the secondary latch receiver 60, as shown in FIG. 17. The third stage begins when the secondary latch 22 achieves the inactive condition, which enables the door handle assembly 500 to move to the opened position, as shown in FIG. 18, to thereby open the door. The transition from the second to the third stage occurs seamlessly and is relatively unnoticeable to the user.

Figure 19:
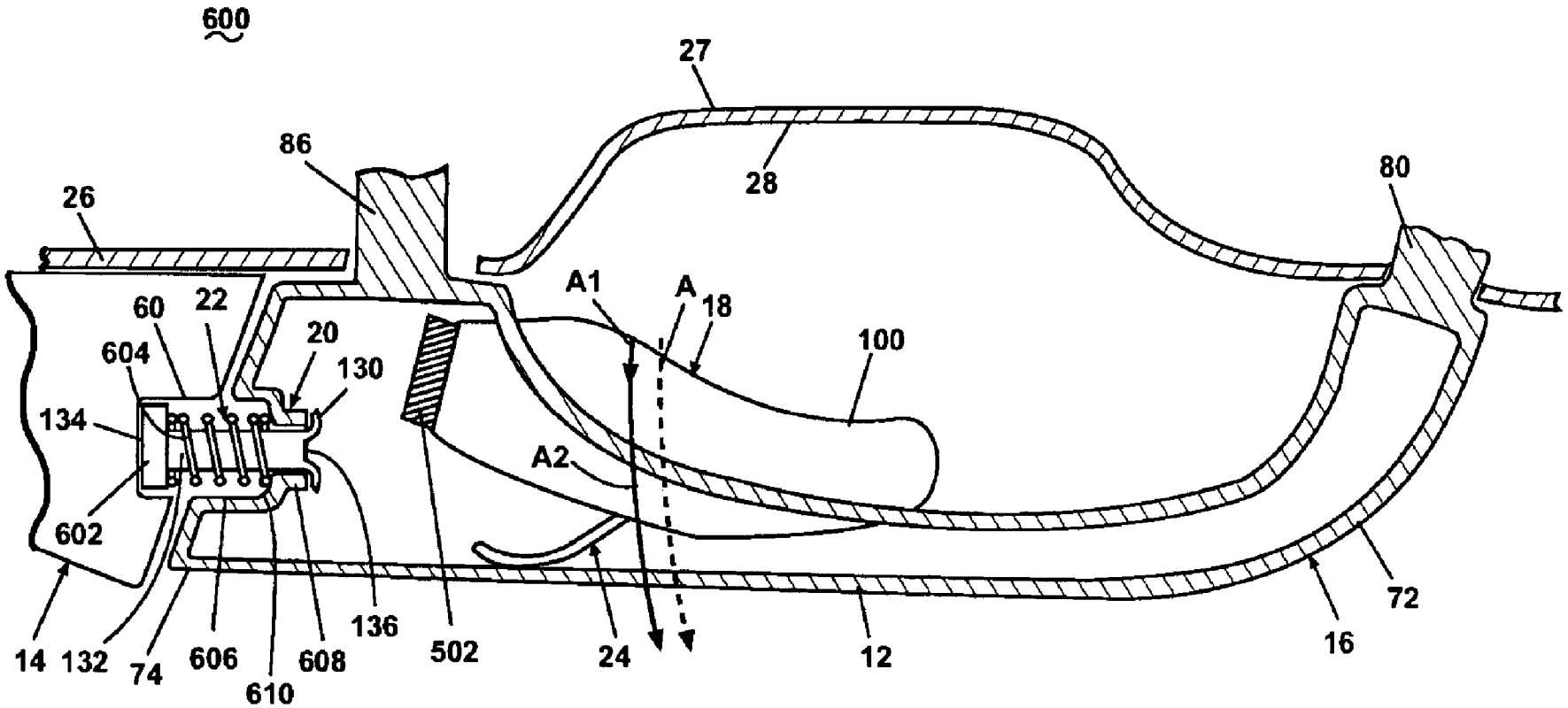
FIG. 19 is a schematic sectional view of a sixth embodiment vehicular door handle assembly according to the invention, wherein the secondary latch is in an active condition and the primary actuator is in a latched position.
Figure 20:
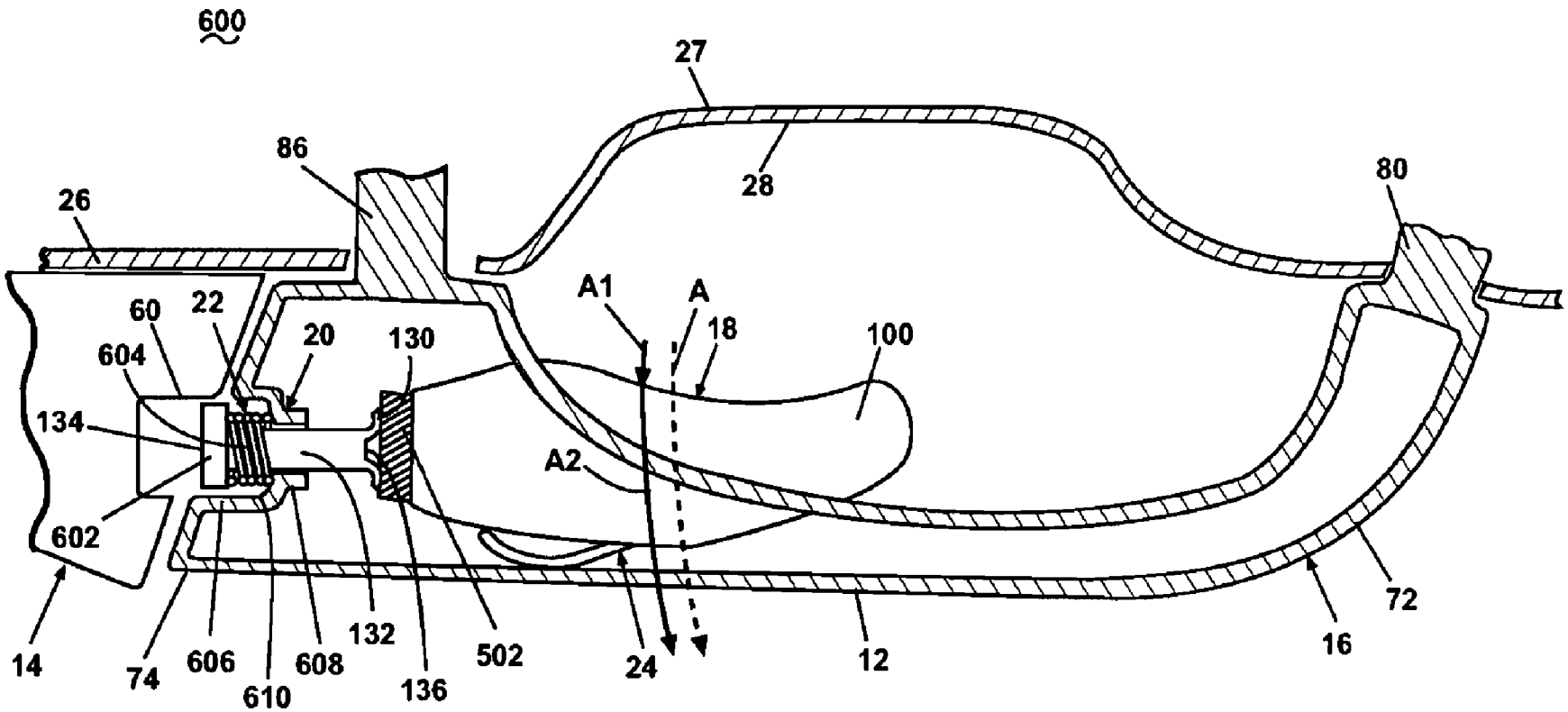
FIG. 20 is a schematic sectional view similar to FIG. 19, wherein the secondary latch is in an inactive condition and the primary actuator is in the latched position.
Figure 21:
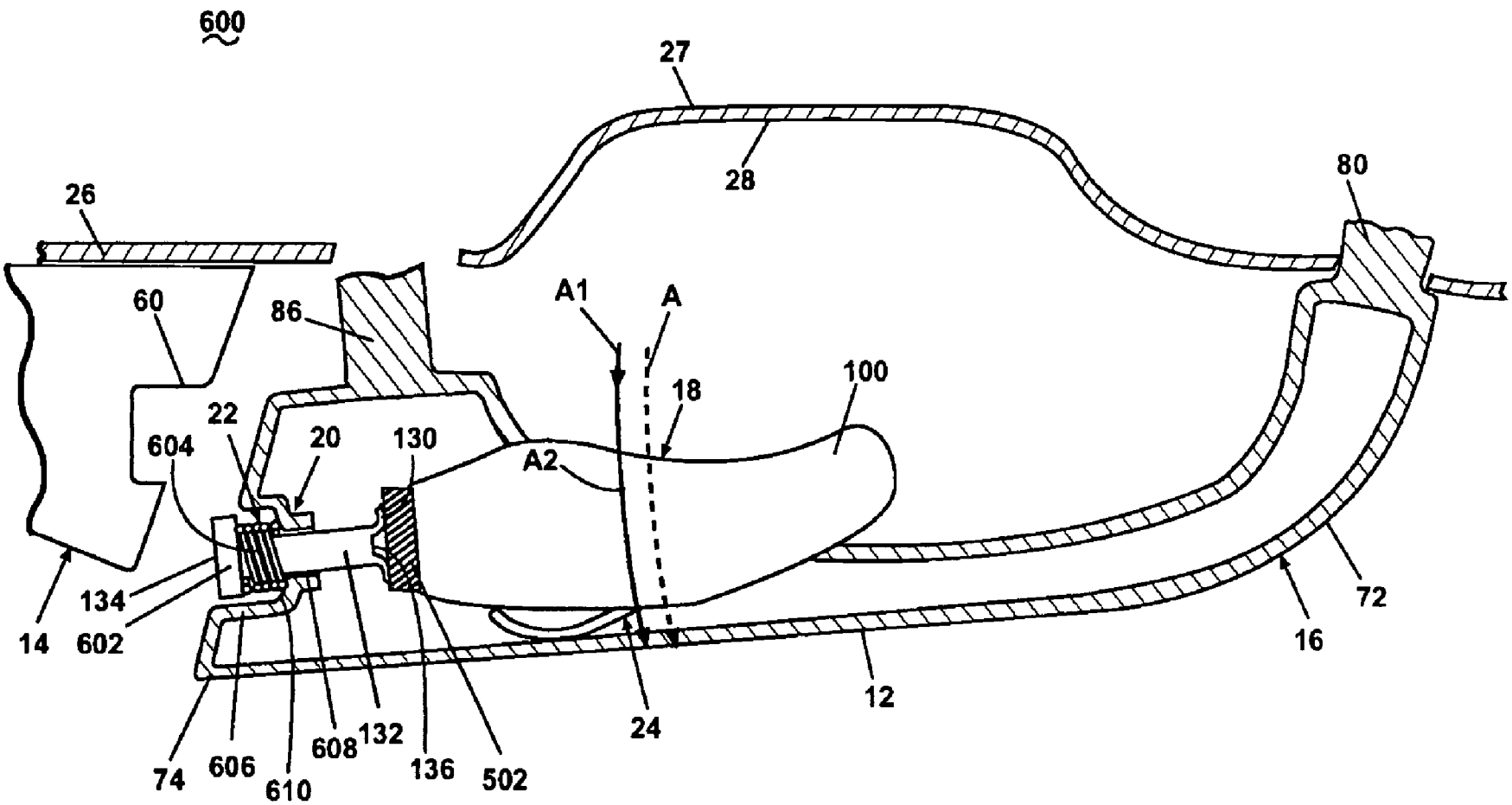
FIG. 21 is a schematic sectional view similar to FIG. 20, wherein the secondary latch is in the inactive condition and the primary actuator is in an opened position.
Figure 22:
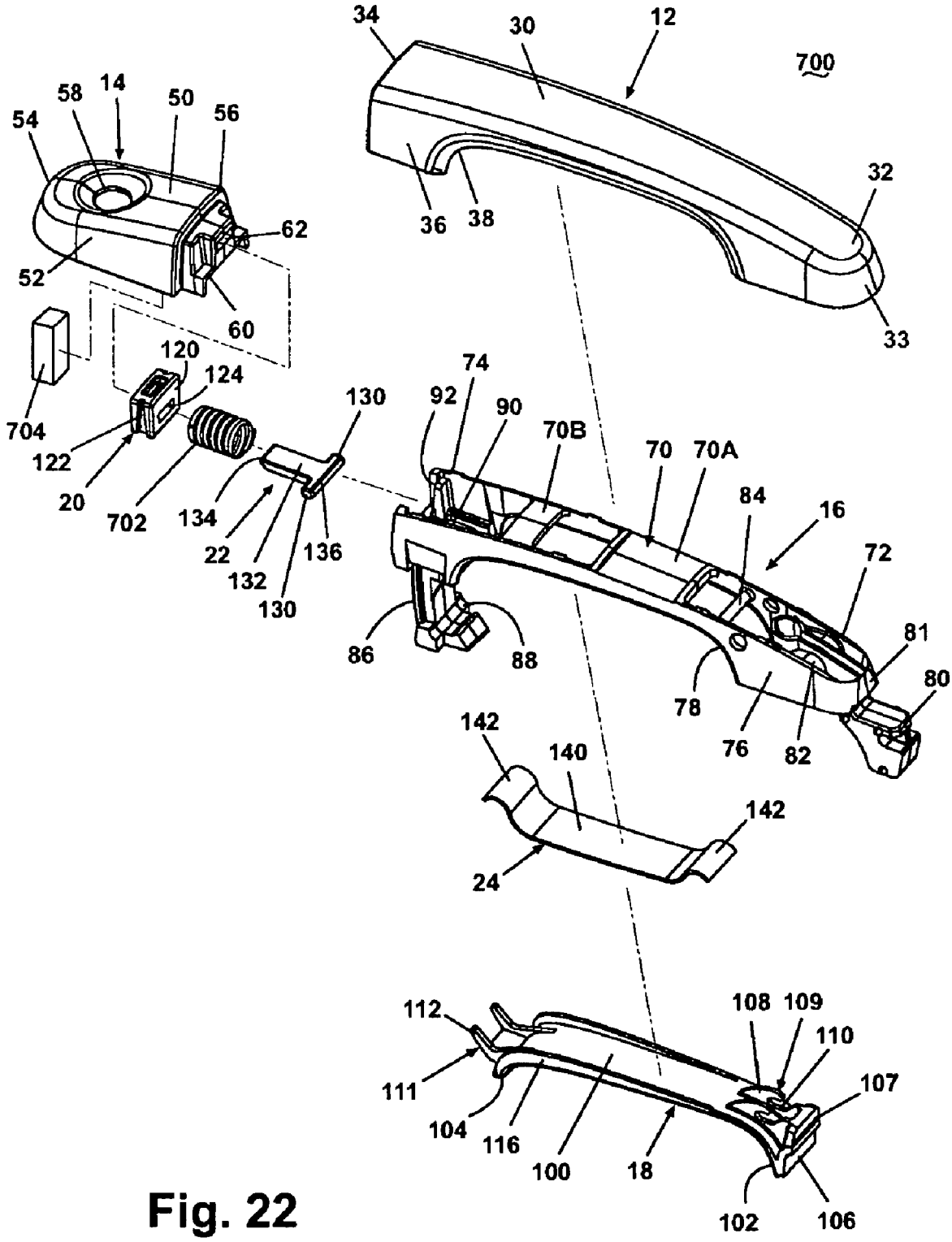
FIG. 22 is an exploded view of a seventh embodiment vehicular door handle assembly according to the invention.

A sixth embodiment vehicular door handle 600 according to the invention is schematically illustrated in FIGS. 19-21, where components similar to those in the previous embodiments are identified with the same reference numeral. The sixth embodiment door handle assembly 600 is substantially identical to the fifth embodiment door handle assembly 500, except that the latch biasing member is a spring 604 rather than the secondary latch receiver magnet 504. The secondary latch 22 comprises a latch body 132 surrounded by the spring 604 and having a retaining head 602 at a rearward end 134 and outward flanges 130 at a forward end 136. A bearing 20 in the housing 16 comprises a cylindrical first portion 606, a second portion 608 of reduced diameter, and a seat 610 between the first and second portions 606, 608. The spring 604 is held between the seat 610 of the bearing 202 and the retaining head 602 on the secondary latch 22. When the trigger magnet 502 is not aligned with the secondary latch 22, the secondary latch 22 defaults to the active condition, shown in FIG. 16, wherein the spring 604 biases the retaining head 602 of the secondary latch 22 and, thus, the secondary latch 22 into the secondary latch receiver 60. However, when the trigger magnet 502, which is stronger than the spring 604, aligns with the secondary latch 22, its magnetic field draws the secondary latch 22 out of the secondary latch receiver 60 and towards the trigger magnet 502 to an inactive condition.

As described with respect to the previous embodiments, the operation of the door handle assembly 600 can essentially be characterized as having three stages: a first stage shown in FIG. 19 wherein the secondary latch 22 is in the active condition and the primary actuator is in a latched position, a second stage shown in FIG. 20 wherein the secondary latch 22 is in the inactive condition and the primary actuator is in the latched position, and a third stage shown in FIG. 21 wherein the secondary latch 22 is in the inactive condition and the primary actuator is in an opened position. In the first stage, the spring 604 forces the rearward end 124 and the retaining head 602 of the secondary latch 22 into the secondary latch receiver 60 to prevent movement of the housing 16 away from the door panel 26. Hence, because the secondary latch 22 is in the active condition, the door handle assembly 600 cannot pivot from the latched position to open the door.

When the user desires to open the door, the user grasps the door handle assembly 600 in a normal fashion, i.e., with the palm of the hand positioned against the handle grip 12 and the fingers wrapped around the housing 16. The user then pulls on the door handle assembly 600 in a normal fashion, i.e., pulls the housing 16 and the handle grip 12 away from the door panel 26. Due to the position of the trigger 18, the user also pulls the trigger grip 100 towards the handle grip 12 and against the bias of the biasing member 24. During the second stage, depression of the trigger 18 aligns the trigger magnet 502 with the secondary latch 22. Because the trigger magnet 502 is stronger than the spring 604, the secondary latch 22 moves towards the trigger magnet 502 to the inactive condition, wherein the retaining head 602 of the secondary latch 22 no longer resides within the secondary latch receiver 60, as shown in FIG. 20. The third stage begins when the secondary latch 22 achieves the inactive condition, which enables the door handle assembly 600 to move to the opened position, as shown in FIG. 21, to thereby open the door. The transition from the second to the third stage occurs seamlessly and is relatively unnoticeable to the user.

A seventh embodiment vehicular door handle 700 according to the invention is schematically illustrated in FIGS. 22-25, where components similar to those in the previous embodiments are identified with the same reference numeral. The sixth embodiment door handle assembly 700 is substantially identical to the first embodiment door handle assembly 10 that is illustrated in FIGS. 1-5, except for the following features related to the secondary latch 22 and activation thereof. The secondary latch mounts 111 on the trigger 18 of the present embodiment each comprise only one arm 112 that interacts with the flanges 130 on the secondary latch 22 for moving the secondary latch 22 to the inactive condition. Additionally, the secondary latch 22 is biased to the inactive condition (away from the secondary latch receiver 60) by a biasing member, such as a spring 702, that surrounds the latch body 132 and abuts the bearing 20 and the flanges 136. Furthermore, the end cap 14 comprises a secondary latch receiver magnet 704 directly adjacent the secondary latch channel 62. The secondary latch 22 is composed of a magnetic material and, therefore, is attracted to the magnet 704. However, the force of the magnet 704, which is preferably a permanent magnet, such as a rare earth magnet, is stronger than that of the spring 702. As a result, the magnet 704 functions as the latch biasing member and biases the secondary latch 22 into the secondary latch receiver 60 and against the bias of the spring 702 to the active condition when the secondary latch 22 is aligned with the secondary latch channel 62.

Figure 23:
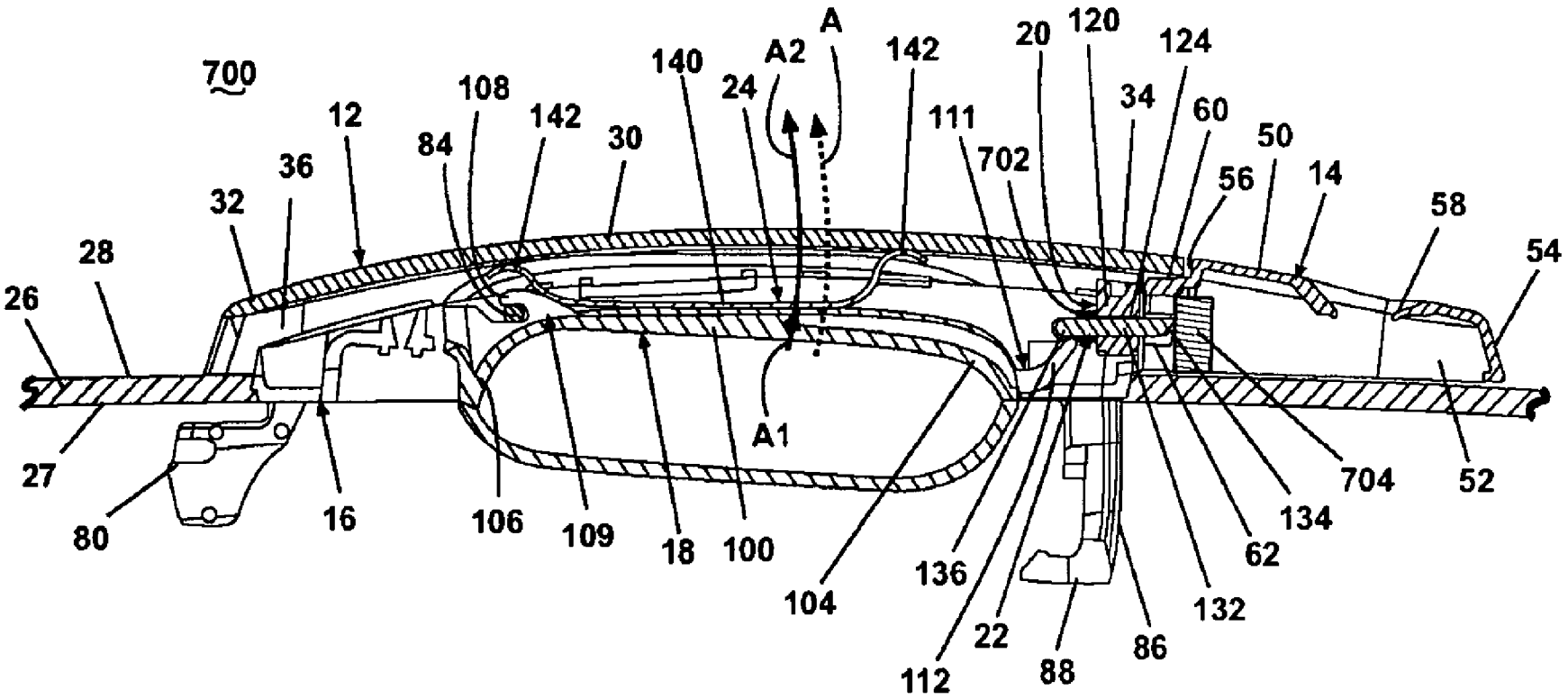
FIG. 23 is a sectional view of the vehicular door handle assembly shown in FIG. 22, wherein the secondary latch is in an active condition and the primary actuator is in a latched position.
Figure 24:
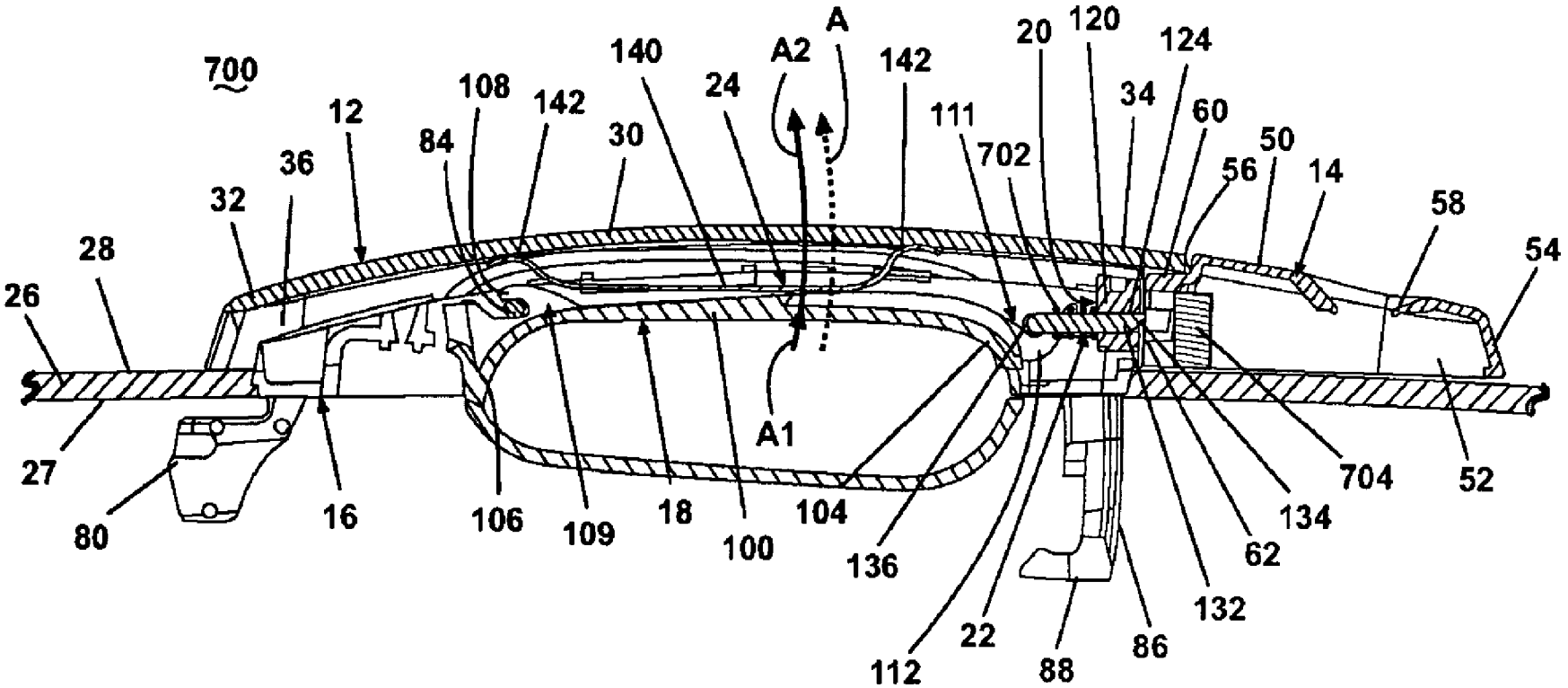
FIG. 24 is a sectional view similar to FIG. 23, wherein the secondary latch is in an inactive condition and the primary actuator is in the latched position.
Figure 25:
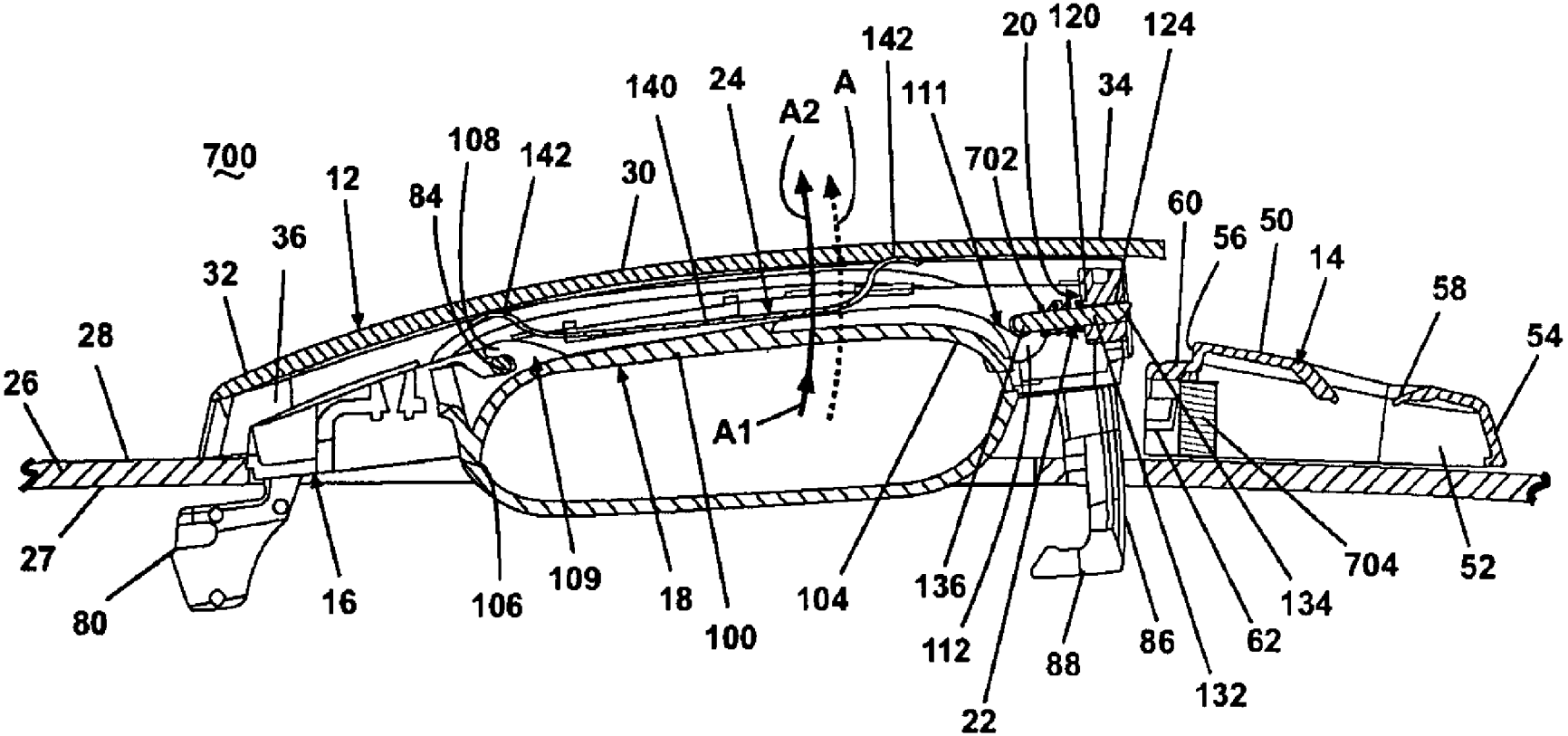
FIG. 25 is a sectional view similar to FIG. 24, wherein the secondary latch is in the inactive condition and the primary actuator is in an opened position.

As described with respect to the previous embodiments, the operation of the door handle assembly 700 can essentially be characterized as having three stages: a first stage shown in FIG. 23 wherein the secondary latch 22 is in the active condition and the primary actuator is in a latched position, a second stage shown in FIG. 24 wherein the secondary latch 22 is in the inactive condition and the primary actuator is in the latched position, and a third stage shown in FIG. 25 wherein the secondary latch 22 is in the inactive condition and the primary actuator is in an opened position. During the first stage, which corresponds to when the door is closed and unaffected by the user, such as when the vehicle is in motion, the housing 16 is aligned with the end cap 14 so that the passageway 124 in the bearing 20 is aligned with the secondary latch channel 62 in the secondary latch receiver 60. As shown in FIG. 23, the biasing member 24 biases the trigger 18 away from the handle grip 12 to the secure position, and the magnet 704 draws the rearward end 134 of the secondary latch 22 into the secondary latch channel 62 and against the bias of the spring 702 to hold the secondary latch 22 in the active condition. When the secondary latch 22 is in the active condition, the housing 16 cannot move relative to the end cap 14 or the door panel 26; therefore, the door handle assembly 700 cannot pivot about the pivot member 80. Hence, the primary actuator cannot be inadvertently moved to the opened position, and the door is prevented from undesirably opening. Due to the biasing member 24, the trigger 18 is normally in the secure position and, thus, the secondary latch 22 defaults to the active condition and will remain in the active condition until the user actuates the trigger 18.

When the user desires to open the vehicle door from the exterior side 28 of the door panel 26, the user grasps the handle grip 12 in a normal fashion, i.e., with the palm of the hand positioned against the upper wall 30 of the handle grip 12 and the fingers wrapped around the handle grip 12 and the housing 16 at the arcuate cutouts 38, 78. Because the trigger grip 100 is aligned with the arcuate cutouts 38, 78, the user also grasps the trigger 18 when the user grasps the handle grip 12 and the housing 16. The user then pulls on the door handle assembly 700 in a normal fashion, i.e., pulls the housing 16 and the handle grip 12 away from the door panel 26. Because the trigger 18 is coincident with the arcuate cutouts 38, 78, the user also pulls on the trigger 18 when pulling the door handle assembly 700 in a normal fashion. During this movement, the door handle assembly 700 seamlessly transitions through the second and third stages. In the second stage, the user pivots the trigger 18 against the bias of the biasing member 24 and towards the upper wall 70 of the housing 16 to the release position. As the trigger 18 pivots, the arms 112 engage the flanges 136 of the secondary latch 22, and the arms 112 pull the secondary latch 22 forward against the force of the magnet 704 and with the bias of the spring 702 to the inactive condition wherein the rearward end 134 no longer resides in the secondary latch channel 62, as shown in FIG. 24. Once the secondary latch 22 is in the inactive condition, the user can continue to pull on the handle grip 12 and the housing 16 to pivot the door handle assembly 700 about the pivot member 80 to the opened position, as shown in FIG. 25 (the third stage), and thereby open the vehicle door.

After the door is opened, the user releases the housing 16 and handle grip 12 and, thus, the trigger 18, which moves away from the housing 16 under the force of the biasing member 24. When the user releases the trigger 18, the spring 702 keeps the secondary latch 22 in the inactive condition until the passageway 124 in the bearing 20 aligns with the secondary latch channel 62 in the secondary latch receiver 60 when the housing 16 aligns with the end cap 14. Once the passageway 124 aligns with the secondary latch channel 62, the magnet 704 draws the secondary latch 22 rearward into the secondary latch receiver 60 to the active condition to prevent inadvertent movement of the door handle assembly 700 to the opened position, as described above for the first stage.

The several embodiments of the vehicular door handle assembly described herein all comprise a secondary actuator in operative communication with a secondary latch to move the secondary latch between active and inactive conditions. During use of the door handle assemblies, the secondary latch by default is in the active condition to prevent undesired or inadvertent movement of the primary actuator to the opened position, such as during an impact. In order to open the door, the user must first place the secondary latch in the inactive condition and then move the primary actuator to the opened position. The secondary actuator is conveniently positioned such that the user grasps the secondary actuator when grasping the primary actuator in a normal fashion. Thus, the user can quickly and easily open the vehicle door by moving the secondary actuator and the primary actuator along a common actuation path to thereby place the secondary latch in the inactive condition and move the primary actuator to the opened position.

While the invention has been specifically described in connection with certain specific embodiments thereof, it is to be understood that this is by way of illustration and not of limitation, and the scope of the appended claims should be construed as broadly as the prior art will permit.

The invention claimed is:

1. A vehicular door handle assembly for selectively opening a vehicle door, the door handle assembly comprising:

a primary actuator adapted to be mounted to a vehicle door, wherein the primary actuator has a first user interaction portion for moving the primary actuator between a latched position and an opened position, and wherein the vehicle door is opened by a user by moving the user interaction portion of the primary actuator between the latched position and the opened position; and a secondary actuator operatively associated with the primary actuator and comprising a cam having at least one pair of arms that define a groove therebetween, wherein the secondary actuator has a second user interaction portion for moving the secondary actuator between a secure position, wherein movement of the primary actuator from the latched position to the opened position is prevented, and a release position, wherein the primary actuator can move from the latched position to the opened position;

a latch operatively associated with the secondary actuator comprising at least one flange slidingly received by the groove to effect the linear movement of the latch, and operable between an active condition, wherein the latch prevents movement of the primary actuator from the latched position, and an inactive condition, wherein the latch allows movement of the primary actuator from the latched position;

a latch receiver adapted to be mounted to the vehicle door adjacent the primary actuator such that the latch is partially received by the latch receiver and partially received by the primary actuator when the latch is in the active condition;

a biasing member that biases the secondary actuator to the secure position and the latch to the active condition, wherein movement of the secondary actuator against the bias of the biasing member to the release position withdraws the latch from the latch receiver to inactivate the latch;

wherein the second user interaction portion is aligned with at least a portion of the first user interaction portion so that attempted movement by a user of the primary actuator out of the latched position first causes the secondary actuator to be moved from the secure position to the release position, wherein movement of the secondary actuator from the secure position to the release position inactivates, release position inactivates the latch, the secondary actuator is pivotally mounted to the primary actuator, and pivotal movement of the secondary actuator relative to the primary actuator translates into linear movement of the latch relative to the latch receiver.

2. The vehicular door handle assembly according to claim 1, wherein the primary actuator comprises a handle, and the first user interaction portion comprises a handle hand grip region.

3. The vehicular door handle assembly according to claim 2, wherein the secondary actuator comprises a trigger mounted to the handle, and the second user interaction portion comprises a trigger hand grip region.

4. The vehicular door handle assembly according to claim 3, wherein during the attempted movement of the primary actuator out of the latched position, the user grasps both the handle hand grip region and the trigger hand grip region and moves the trigger hand grip region towards the handle hand grip region to move the trigger from the secure position to the release position.

5. The vehicular door handle assembly according to claim 4, wherein the trigger is pivotally mounted to the handle.

6. A vehicular door handle assembly for selectively opening a vehicle door, the door handle assembly comprising:

a primary actuator adapted to be mounted to an exterior surface of a vehicle door, wherein the primary actuator has a first user interaction portion for moving the primary actuator between a latched position and an opened position, and wherein the vehicle door is opened by a user by moving the user interaction portion of the primary actuator between the latched position adjacent the exterior surface and the opened position away from the exterior surface;

a secondary actuator pivotally mounted to the primary actuator, wherein the secondary actuator has a second user interaction portion for moving the secondary actuator between a secure position, wherein movement of the primary actuator from the latched position to the opened position is prevented, and a release position, wherein the primary actuator can move from the latched position to the opened position;

a latch associated with the secondary actuator for movement alongside the exterior surface from one of the secure position and the release position to the other of the secure position and the release position;

a latch receiver adapted to be mounted to the vehicle door adjacent the primary actuator such that the latch is partially received by the latch receiver and partially received by the primary actuator when the latch is in the active condition; and a biasing member that biases the secondary actuator to the secure position and the latch to the active condition, and movement of the secondary actuator against the bias of the biasing member to the release position withdraws the latch from the latch receiver to inactivate the latch;

wherein the latch comprises at least one flange, the secondary actuator comprises a cam comprising at least one pair of arms that define a groove therebetween; and the at least one flange is slidingly received by the groove to effect the linear movement of the latch; and wherein pivotal movement of the secondary actuator relative to the primary actuator translates into linear movement of the latch relative to the latch receiver; and wherein the second user interaction portion is aligned with at least a portion of the first user interaction portion so that attempted movement of the primary actuator by the user out of the latched position first causes the latch to be moved from the secure position to the release position.

7. The vehicular door handle assembly according to claim 6, wherein the primary actuator comprises a handle, and the first user interaction portion comprises a handle hand grip region.

8. The vehicular door handle assembly according to claim 7, wherein the secondary actuator comprises a trigger mounted to the handle, and the second user interaction portion comprises a trigger hand grip region.

9. The vehicular door handle assembly according to claim 8, wherein during the attempted movement of the primary actuator out of the latched position, the user grasps both the handle hand grip region and the trigger hand grip region and moves the trigger hand grip region towards the handle hand grip region to move the trigger from the secure position to the release position.

10. The vehicular door handle assembly according to claim 9, wherein the trigger is pivotally mounted to the handle.

* * * * *

UNITED STATES PATENT AND TRADEMARK OFFICE

CERTIFICATE OF CORRECTION

PATENT NO. : 7,284,776 B2
APPLICATION NO. : 10/710806
DATED : October 23, 2007
INVENTOR(S) : Jerry Cummins et al.

It is certified that error appears in the above-identified patent and that said Letters Patent is hereby corrected as shown below:

Column 2, lines 33-38 reads:
The vehicular door handle assembly according can further comprise a biasing member that biases the secondary actuator to the secure position and the latch to the active condition, and movement of the secondary actuator against the bias of the biasing member to the release position withdraws the latch from the latch receiver to the inactivate the latch.

It should read:
The vehicular door handle assembly according to the invention can further comprise a biasing member that biases the secondary actuator to the secure position and the latch to the active condition, and movement of the secondary actuator against the bias of the biasing member to the release position withdraws the latch from the latch receiver to inactivate the latch.

Column 2, lines 54-59 reads:
Alternatively, the latch can comprise at least one flange, the secondary actuator can comprises at least one arm, and during the movement of the primary actuator from the secure position to the release position, the at least one arm abuts the at least one flange to induce movement of the latch out of the latch receiver to the inactive condition.

It should read:
Alternatively, the latch can comprise at least one flange, the secondary actuator can comprise at least one arm, and during the movement of the primary actuator from the secure position to the release position, the at least one arm abuts the at least one flange to induce movement of the latch out of the latch receiver to the inactive condition.

Column 2, lines 60-62 reads:
Alternatively, the secondary actuator can comprises a button connected to the latch through a pivot arm pivotally mounted the primary actuator.

It should read:
Alternatively, the secondary actuator can comprise a button connected to the latch through a pivot arm pivotally mounted to the primary actuator.

Column 3, lines 26-35 reads:
The latch can extend through an aperture in a door panel of the vehicular door and can comprises a detent that abuts an inside surface of the door panel when the latch is in the active condition, and wherein pivotal movement of the trigger from the secure position to the release position removes the detent from abutting contact with the inside surface the door panel to inactivate the latch so that the paddle can move from the latched position to the opened position.

UNITED STATES PATENT AND TRADEMARK OFFICE

CERTIFICATE OF CORRECTION

PATENT NO. : 7,284,776 B2
APPLICATION NO. : 10/710806
DATED : October 23, 2007
INVENTOR(S) : Jerry Cummins et al.

It is certified that error appears in the above-identified patent and that said Letters Patent is hereby corrected as shown below:

It should read:
The latch can extend through an aperture in a door panel of the vehicular door and can comprises a detent that abuts an inside surface of the door panel when the latch is in the active condition, and wherein pivotal movement of the trigger from the secure position to the release position removes the detent from abutting contact with the inside surface of the door panel to inactivate the latch so that the paddle can move from the latched position to the opened position.

Column 4, lines 64-67 reads:
FIG. 7 is a schematic sectional view of the vehicular door handle assembly shown in FIG. 6, wherein the secondary latch is in an active condition and the primary actuator is in a latched position.

Figure 6:
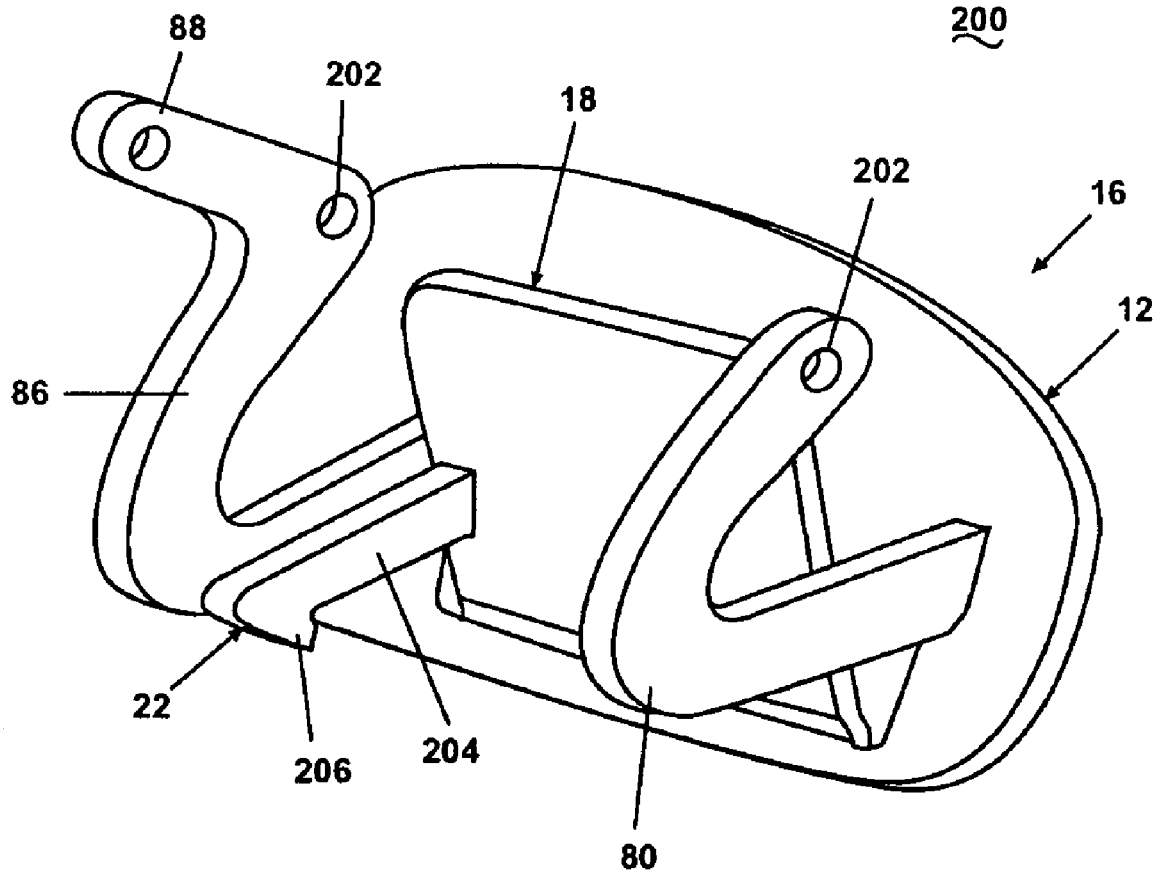
FIG. 6 is a schematic perspective view of a second embodiment vehicular door handle assembly according to the invention.

It should read:

FIG. 7 is a schematic sectional view of the vehicular door handle assembly shown in FIG. 6, wherein the secondary latch is in an active condition and the primary actuator is in a latched position.

Column 9, lines 14-16 reads:
During assembly, the bearing 20 can be slid onto the projections 92 before the handle grip 12 is attached to the housing 12.

It should read:
During assembly, the bearing 20 can be slid onto the projections 92 before the handle grip 12 is attached to the housing 16.

Column 9, lines 26-29 reads:
When the secondary latch 22 is in the inactive condition, the rearward end 134 is shifted towards the bearing 20 such that it is no longer received by the secondary larch channel 62.

It should read:
When the secondary latch 22 is in the inactive condition, the rearward end 134 is shifted towards the bearing 20 such that it is no longer received by the secondary latch channel 62.

UNITED STATES PATENT AND TRADEMARK OFFICE

CERTIFICATE OF CORRECTION

PATENT NO. : 7,284,776 B2
APPLICATION NO. : 10/710806
DATED : October 23, 2007
INVENTOR(S) : Jerry Cummins et al.

It is certified that error appears in the above-identified patent and that said Letters Patent is hereby corrected as shown below:

Column 11, lines 26-30 reads:
Hence, the primary and secondary actuators share a common actuation path A, and, when the user grasps the primary actuator and the secondary actuation to open the door, the user senses only a single movement through the common actuation path A.

It should read:
Hence, the primary and secondary actuators share a common actuation path A, and, when the user grasps the primary actuator and the secondary actuator to open the door, the user senses only a single movement through the common actuation path A.

Column 13, lines 3-7 reads:
Similar to the first embodiment, the housing 16 includes, at a forward end 72, a pivot member 80 and, a rearward end 74, a primary latch actuator 86 that extend through apertures in the door panel 26 to reside on the interior side 27 of the door panel 26.

It should read:
Similar to the first embodiment, the housing 16 includes, at a forward end 72, a pivot member 80 and, at a rearward end 74, a primary latch actuator 86 that extend through apertures in the door panel 26 to reside on the interior side 27 of the door panel 26.

Column 15, lines 30-35 reads:
Similar to most of the previous embodiments, the housing 16 includes, at a forward end 72, a pivot member 80 and, a rearward end 74, a primary latch actuator 86 that extend through apertures in the door panel 26 to reside on the interior side 27 of the door panel 26.

UNITED STATES PATENT AND TRADEMARK OFFICE

CERTIFICATE OF CORRECTION

PATENT NO. : 7,284,776 B2
APPLICATION NO. : 10/710806
DATED : October 23, 2007
INVENTOR(S) : Jerry Cummins et al.

It is certified that error appears in the above-identified patent and that said Letters Patent is hereby corrected as shown below:

It should read:
Similar to most of the previous embodiments, the housing 16 includes, at a forward end 72, a pivot member 80 and, at a rearward end 74, a primary latch actuator 86 that extends through apertures in the door panel 26 to reside on the interior side 27 of the door panel 26.

Signed and Sealed this

Eighteenth Day of March, 2008

JON W. DUDAS
*Director of the United States Patent and Trademark Office*